US008590351B2

(12) United States Patent
Ookawara et al.

(10) Patent No.: US 8,590,351 B2
(45) Date of Patent: Nov. 26, 2013

(54) SIDE-LOCK DEVICE

(75) Inventors: Toshihiko Ookawara, Kanagawa (JP); Toshihiro Shimizu, Kanagawa (JP)

(73) Assignee: Piolax Inc., Yokohama-Shi, Kanagawa (JP)

( * ) Notice: Subject to any disclaimer, the term of this patent is extended or adjusted under 35 U.S.C. 154(b) by 20 days.

(21) Appl. No.: 12/998,212

(22) PCT Filed: Sep. 29, 2009

(86) PCT No.: PCT/JP2009/066887
§ 371 (c)(1),
(2), (4) Date: Mar. 25, 2011

(87) PCT Pub. No.: WO2010/038716
PCT Pub. Date: Apr. 8, 2010

(65) Prior Publication Data

US 2011/0174027 A1 Jul. 21, 2011

(30) Foreign Application Priority Data

Oct. 1, 2008 (JP) ..... P.2008-256482

(51) Int. Cl.
*E05C 1/12* (2006.01)

(52) U.S. Cl.
USPC ..... 70/162; 70/109; 292/37; 292/163; 292/169

(58) Field of Classification Search
USPC ..... 70/109, 162; 292/32, 33, 38, 42, 157, 292/159, 162, 34, 37, 137, 138, 163, 169, 292/171, 175
See application file for complete search history.

(56) References Cited

U.S. PATENT DOCUMENTS 5,183,310 A 2/1993 Shaughnessy
5,755,467 A * 5/1998 Dilluvio et al. ..... 292/32
(Continued)

FOREIGN PATENT DOCUMENTS

CN 1526586 A 9/2004
CN 1944930 A 4/2007
(Continued)

OTHER PUBLICATIONS

Chinese Office Action dated Apr. 3, 2013, with English-language translation.
(Continued)

*Primary Examiner* — Christopher Boswell
*Assistant Examiner* — Duoni Pan
(74) *Attorney, Agent, or Firm* — McGinn IP Law Group, PLLC

(57) ABSTRACT

A pair of left and right slide pins 10 and 20 are disposed at the rear side of the lid 1 movably in the lateral direction. The base member 30 is installed in the installation part formed on the lid 1 from the surface side of the lid 1. The operation handle 50 that drives a pair of slide pins 10 and 20 is mounted on the surface side of the base member 30. Also, the rotor 40 causing a pair of slide pins 10 and 20 to interlock in accordance with drive operation of the operation handle 50 is rotatably installed at the base member 30. The rotor 40 has a pair of drive force transmission engagement parts 43 and 43. A pair of slide pins 10 and 20 have the engaged parts 101 and 201, which are separately engaged with one and the other of the pair of drive force transmission engagement parts 43 and 43, respectively. The rotor 40 is mounted in the base member 30 in a state where the respective drive force transmission parts 43 and 43 are exposed to the rear side of the lid 1. The engaged parts 101 and 201 of the respective slide pins 10 and 20 are engaged with the respective drive force transmission engagement parts 43 and 43 of the rotor 40 from the rear side of the lid 1.

20 Claims, 25 Drawing Sheets

(56) References Cited

U.S. PATENT DOCUMENTS

| | | | | |
|---|---|---|---|---|
| 6,361,086 | B1 * | 3/2002 | Robbins et al. | 292/36 |
| 7,032,985 | B1 * | 4/2006 | Ichioka et al. | 312/319.2 |
| 7,048,311 | B2 * | 5/2006 | Sawatani et al. | 292/33 |
| 7,070,215 | B2 * | 7/2006 | Kelley et al. | 292/241 |
| 7,204,527 | B2 | 4/2007 | Geurden | |
| 7,455,333 | B2 | 11/2008 | Ookawara | |
| 7,497,486 | B1 * | 3/2009 | Davis et al. | 292/32 |
| 7,549,684 | B2 * | 6/2009 | Shi et al. | 292/37 |
| 7,585,005 | B1 * | 9/2009 | Cote et al. | 292/38 |
| 7,591,157 | B2 * | 9/2009 | O'Neill et al. | 70/118 |
| 7,695,028 | B2 * | 4/2010 | Katou et al. | 292/34 |
| 8,141,398 | B2 | 3/2012 | Ookawara et al. | |
| 8,167,386 | B2 * | 5/2012 | Bergesch et al. | 312/215 |
| 8,254,091 | B2 * | 8/2012 | Yang | 361/679.01 |
| 2003/0006616 | A1 * | 1/2003 | Katoh et al. | 292/32 |
| 2004/0256859 | A1 * | 12/2004 | Yamada | 292/32 |
| 2007/0080542 | A1 * | 4/2007 | Ookawara | 292/36 |
| 2009/0193860 | A1 * | 8/2009 | Meekma | 70/109 |

FOREIGN PATENT DOCUMENTS

| | | | |
|---|---|---|---|
| CN | 1987030 | A | 6/2007 |
| JP | 39347/1983 | | 3/1983 |
| JP | 2004-156331 | A | 6/2004 |
| JP | 3896028 | B2 | 3/2007 |
| JP | 2007-100343 | A | 4/2007 |
| JP | 4056906 | B2 | 3/2008 |
| JP | 2008-82132 | A | 4/2008 |
| WO | WO 2004/007878 | A1 | 1/2004 |

OTHER PUBLICATIONS

French Search Report dated Jun. 26, 2013, with English-language translation.

* cited by examiner

SIDE-LOCK DEVICE

TECHNICAL FIELD

The present invention relates to a side-lock device that is mounted on a lid for opening and closing a vehicle glove box and maintains a locked state of the lid.

BACKGROUND ART

Conventionally, various types of components have been proposed with respect to the side-lock device.

For example, the side-lock device disclosed in the Patent Document 1 is a device that has previously been proposed by the applicant (assignee) of the present application. The same device is configured so that a pair of cylindrical portions are formed at the left and right sides of an operation handle rotatably mounted on the base member, a cam member is installed into these cylindrical portions, and a slide pin is interlocked to the cam member from both the left and right sides. The cam member composes an operation drive force transmission mechanism for moving the interlocked slide pin in the left and right directions in accordance with turning of the operation handle.

The tip ends of the cam member protrude from both side faces of the base member for carrying out connection work of a slide pin at sides of the base member. However, it is difficult to fit the cam member in the recess of an instrument panel (lid) as an object of installation, in a state where the cam member remains protruding, as shown in FIG. 6 of Patent Document 1. Therefore, there is installed a mechanism for retaining the tip ends of the cam member in a state where the tip ends of the cam member are retracted in the cylindrical portions.

[Patent Document 1] JP-2004-156331-A

DISCLOSURE OF INVENTION

[Problems to be Solved by Invention]

Since, in the side-lock device according to Patent Document 1 described above, the tip ends of the cam member protrude in both sides thereof in a normal state, it was troublesome to carry out installation work in an instrument panel and lid, etc. as an object of installation. Therefore, such a mechanism for retaining the tip ends of the cam member in a state where the tip ends are retracted in the cylindrical portions is installed. However, the retaining mechanism is complicated, and there is a disadvantage which results in an increase in the working cost.

The present invention has been developed in view of such situations, and it is therefore an object of the invention to provide a side-lock device that has a simple configuration and facilitates the mounting work into a lid for opening and closing a vehicle glove box.

[Means for Solving Problems]

In order to achieve the above-described object, the present invention pertains to a side-lock device mounted in a lid for opening and closing a vehicle glove box, which holds the lid in a closed state, and the side-lock device includes:

a pair of left and right slide pins disposed movably in the lateral direction on the rear side of the lid, which holds the lid in a closed state by the tip ends thereof being engaged with locking parts provided at a vehicle side in a state where the tip ends thereof respectively protrude from both side edges of the lid;

a base member installed from the surface side of the lid;

an operating member mounted on the surface side of the base member, which drives the pair of slide pins; and a rotor that is rotatably installed in the base member and is interlocked with the pair of slide pins in accordance with drive operation of the operating member, wherein the rotor has a pair of drive force transmission engagement parts, wherein the pair of slide pins has engaged parts, which are separately engaged with one and the other of the pair of drive force transmission engagement parts, respectively, and wherein there are configured so that the rotor is mounted at the base member in a state where the drive force transmission engagement parts are exposed to the rear side of the lid and so that the respective slide pins cause the engaged parts to engage with the drive force transmission engagement parts of the rotor from the rear side of the lid.

Therefore, according to the invention, since the drive force transmission engagement parts of the rotor for engaging the respective slide pins are exposed to the rear side of the lid, the base member in which the rotor is installed can be easily installed in the lid from the surface side without any hindrance, and furthermore, since it is possible to easily carry out engagement work of the respective slide pins in the drive force transmission engagement parts from the rear side of the lid having the peripheral part opened, such engagement work can be facilitated, and it is possible to easily achieve the work as an entirety.

DESCRIPTION OF REFERENCE NUMERALS

1: Lid, 2: Installation part of side-lock device, 2*a*: Opening area, 2*b*: Operation space, 2*c*: Partition, 2*d*: Engagement wall, 3: First projection piece, 4: Second projection piece, 5,6: Support holes, 7: Projection piece, 10: Drive slide pin, 11: Coil spring, 101: Engaged part, 102: Recessed part, 102*a*: Opening, 102*b*: Reinforcement wall, 103: Locking claw, 110: Drive force receiving part, 111: Inclination surface, 112: Movement regulating side face; 113: Notched part, 120: Installation recessed part, 130: First backlash preventing part, 131: Resilient piece, 140: Second backlash preventing part, 141: Resilient piece, 20: Driven slide pin, 21: Coil spring, 201: Engaged part, 202: Recessed part, 202*a*: Opening, 202*b*: Reinforcement wall, 203: Locking claw, 220: Installation recessed part, 30: Base member, 30*a*, 30*b*: Mounting locking piece, 31: Recess, 32: Rotor assembling part, 32*a*, 32*b*: Cylinder, 32*c*: Key groove, 32*d*: Assembling hole, 32*e*: Spring locking part, 32*f*: Stopper wall, 32*g*: Insertion window, 33: Supporting axis, 34: Penetration hole, 35: Retaining projection, 36: Locking wall, 40: Rotor, 41*a*: Outer cylinder, 41*b*: Inner cylinder, 42: Air deflating hole, 43: Drive force transmission engagement part, 43*a*: Head portion, 43*b*: Body part, 44: O-ring, 45: Supporting axis, 46: Contacting claw, 47: Drive force receiving part, 47*a*: Extension area, 47*b*: Arcuate face area, 48: Spring force receiving part, 50: Operation handle, 51: Coil spring, 52: Supporting hole, 53: Fitting hole, 53*a*: Guide projection rim, 55: Drive projection, 60: Key cylinder, 61*a*, Recessed groove, 62: Locking piece, 63: Drive projection, 64: Key hole, 65: Locking projection, 70: torsion coil spring

BEST MODE FOR CARRYING OUT INVENTION

Hereinafter, a detailed description is given of embodiments of the present invention with reference to the drawings.

A side-lock device according to the embodiments of the present invention is a device that is mounted in a lid for opening and closing a vehicle glove box to hold the lid in a closed state.

First Embodiment

First, referring to FIG. 1 through FIG. 15, a detailed description is given of a side-lock device according to the first embodiment of the present invention.

Figure 1:
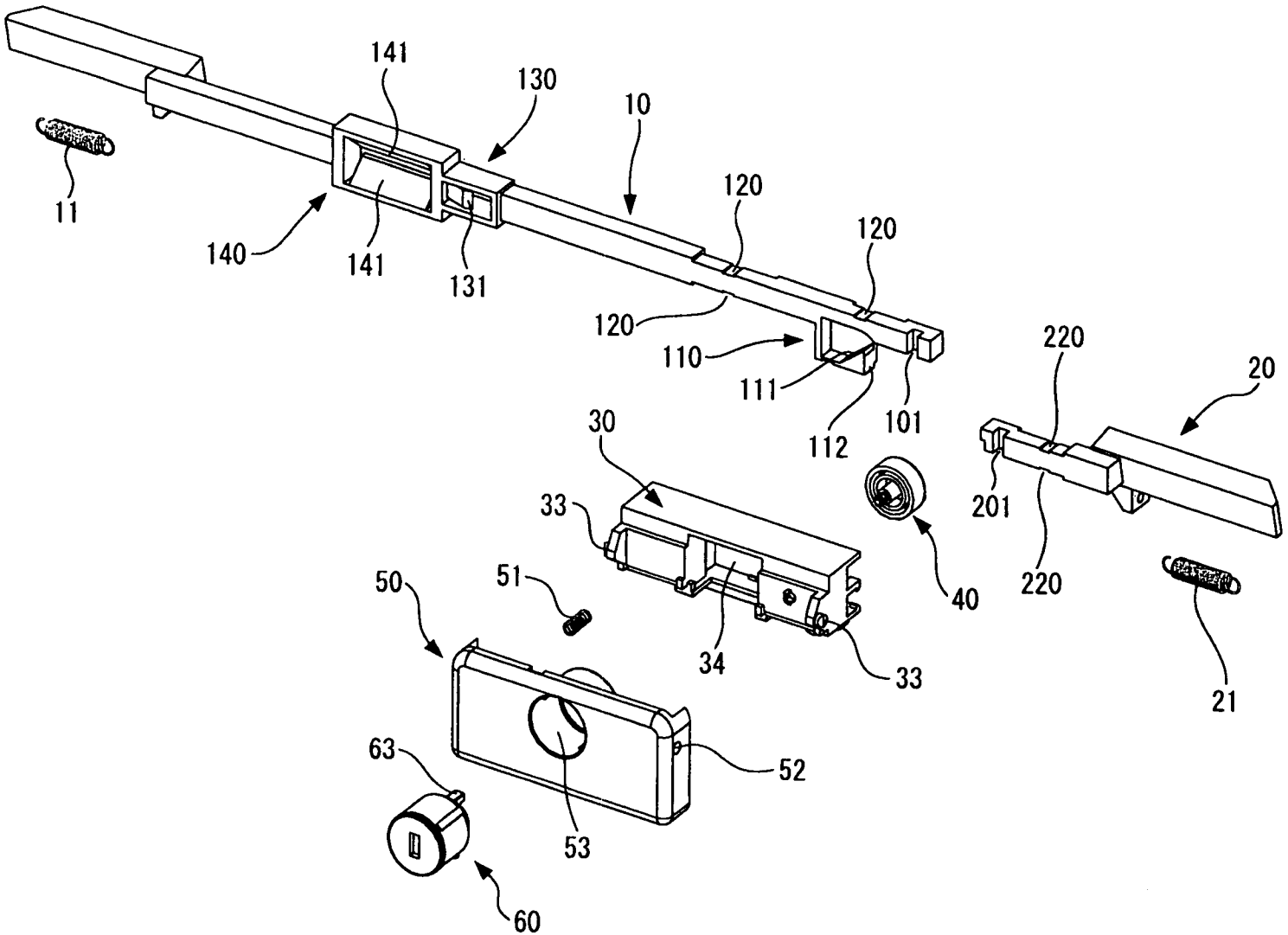
FIG. 1 is a disassembled perspective view showing respective components of a side-lock device according to the first embodiment of the present invention, as viewed obliquely from front.
Figure 2:
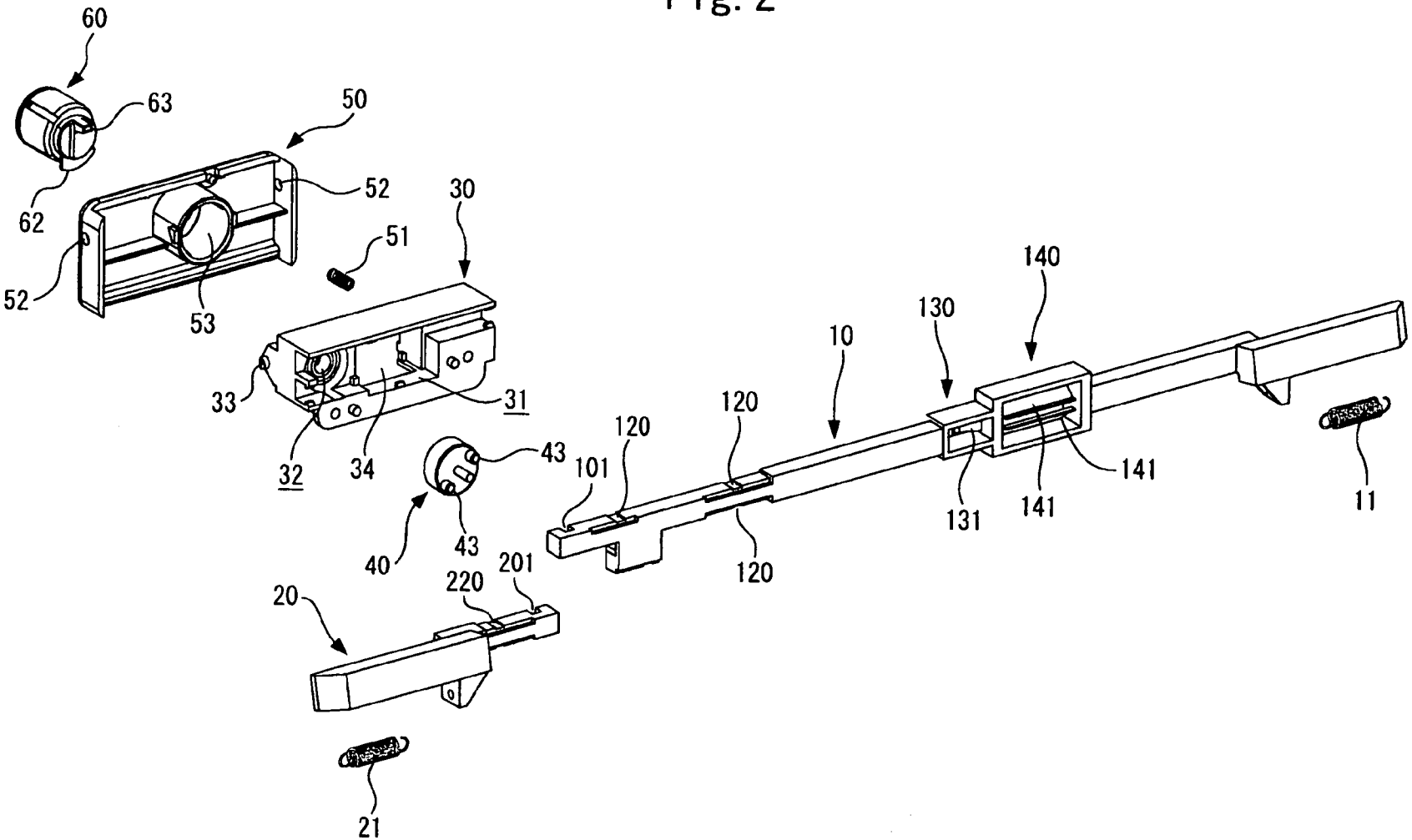
FIG. 2 is a disassembled perspective view showing respective components of a side-lock device according to the first embodiment of the present invention, as viewed obliquely from rear.
Figure 3:
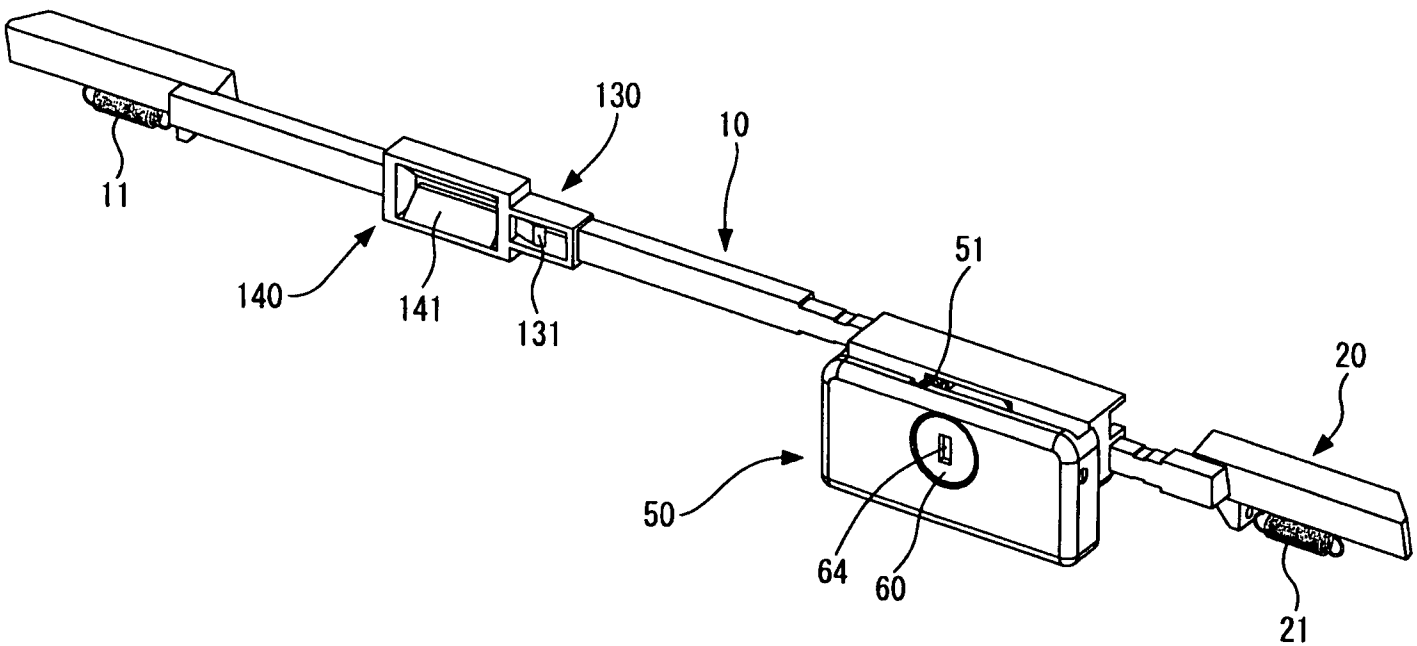
FIG. 3 is a perspective view showing an assembled state of respective components of a side-lock device according to the first embodiment of the present invention, as viewed obliquely from front.
Figure 4:
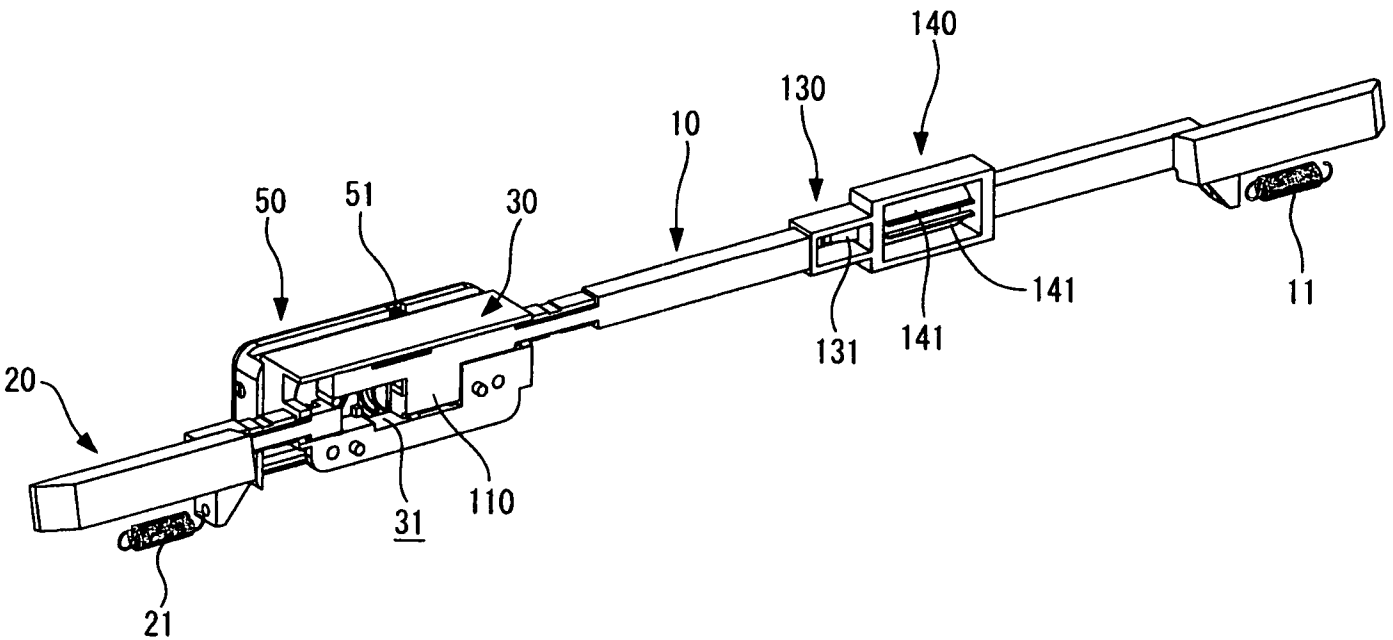
FIG. 4 is a perspective view showing an assembled state of respective components of a side-lock device according to the first embodiment of the present invention, as viewed obliquely from rear.

As shown in FIG. 1 and FIG. 2, the side-lock device according to the present embodiment includes a pair of left and right slide pins 10, 20, coil springs 11, 21, a base member 30, a rotor 40, an operation handle 50, a coil spring 51, and a key cylinder 60 as the components. Of these components, the respective components excluding the metal-made coil springs 11, 21, 51 and the key cylinder 60 are resin-molded parts.

Figure 6:
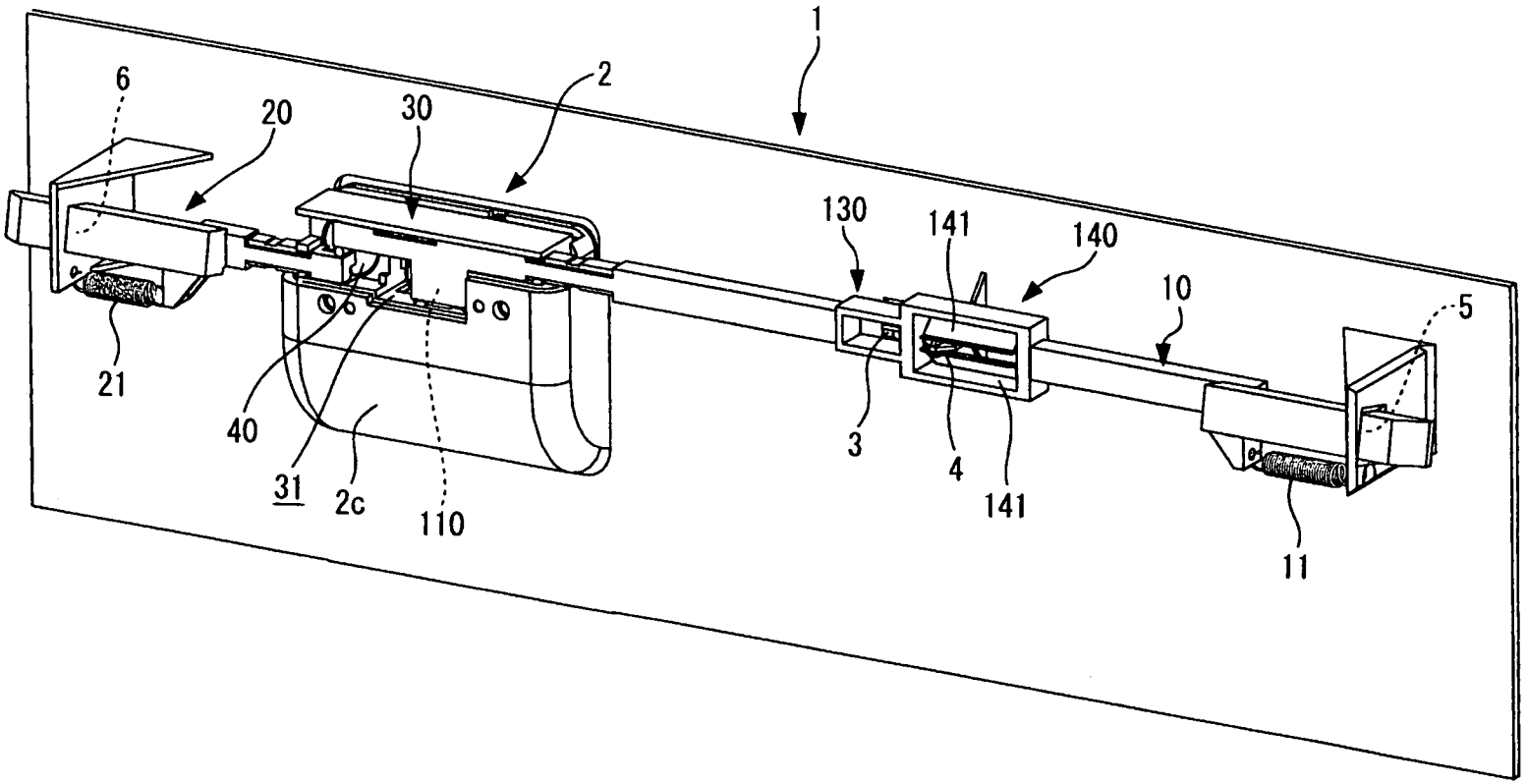
FIG. 6 is a perspective view showing a completed state, where a side-lock device according to the first embodiment of the present invention is assembled on the lid, as viewed obliquely from rear.

As shown in FIG. 1 and FIG. 2, with respect to the pair of left and right slide pins 10 and 20, one thereof is a long drive slide pin 10, and the other thereof is a short driven slide pin 20. As shown in FIG. 6, the slide pins 10 and 20 are assembled to the rear side of the lid 1 and are made movable in the lateral direction. The tip end of the drive slide pin 10 is composed so as to protrude outward from the one side edge (the right side edge in FIG. 6) of the lid 1 and to retract thereinto. In the same way, the tip end of the driven slide pin 20 is composed so as to protrude outward from the other side edge (the left side edge in FIG. 6) of the lid 1 and to retract thereinto. The tip ends of the respective slide pins 10 and 20 protrude from both side edges of the lid 1 and are locked at the locking parts provided at the vehicle side (not illustrated) . Accordingly, a closed state of the lid 1 is maintained.

Figure 5:
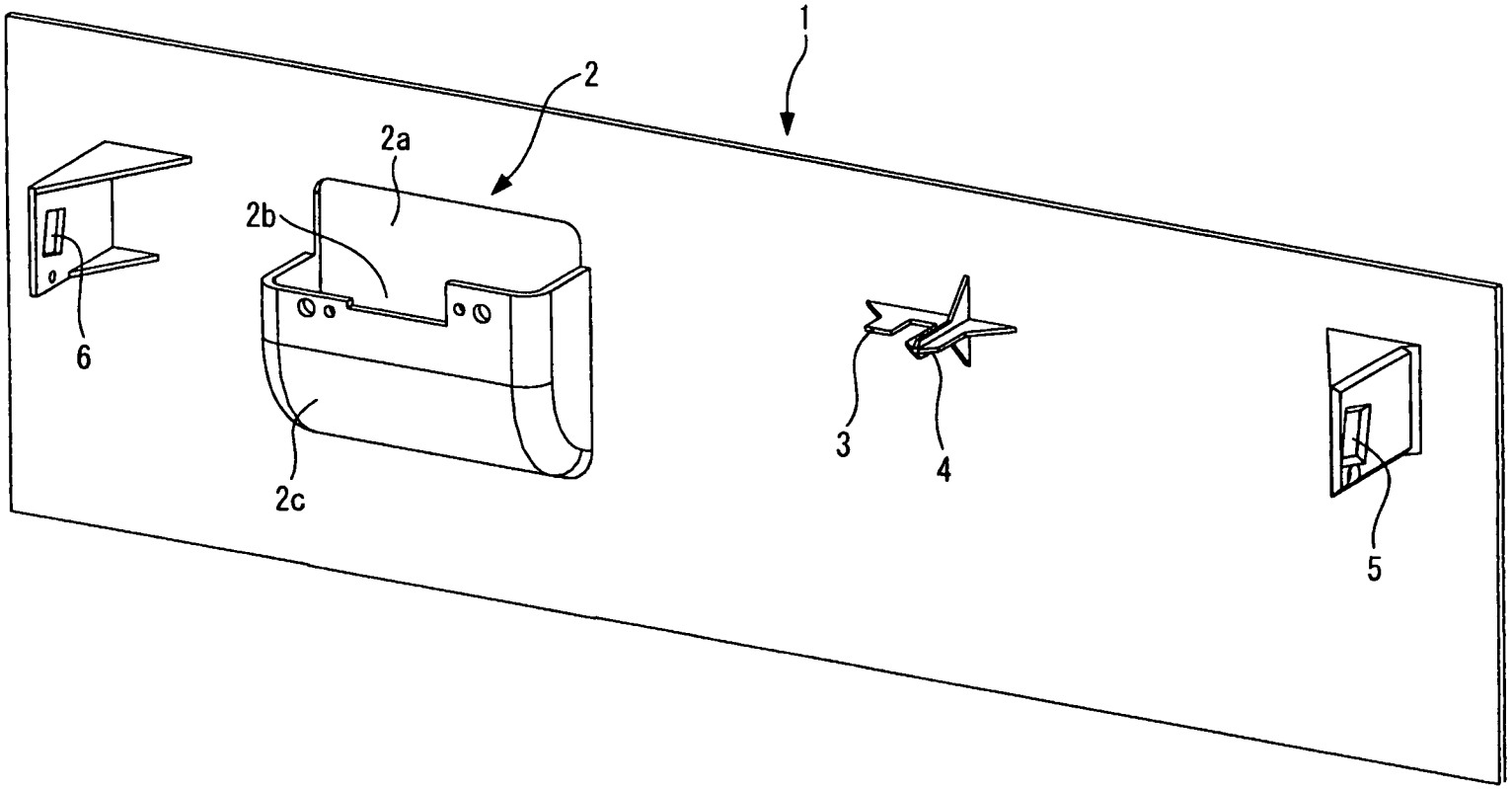
FIG. 5 is a perspective view showing a lid, as viewed obliquely from rear.

Also, the lid 1 shown in FIG. 5 and FIG. 6 is a component called an outer lid, and is used in a state where the lid 1 is assembled to the front side of an inner lid including an accommodation part. It is a matter of course that a lid in which a side-lock device according to the present invention is assembled is not only to an outer lid but also various types of lids such as a lid not divided into an outer part and an inner part.

As shown in FIG. 1 through FIG. 4, in the base member 30, the operation handle 50 and the coil spring 51 are assembled thereto from the surface side thereof, and the rotor 40 and the respective slide pins 10 and 20 are assembled thereto from the rear side thereof. In addition, the operation handle 50 is provided with a key cylinder 60 assembled thereto from the surface side thereof.

Figure 7:
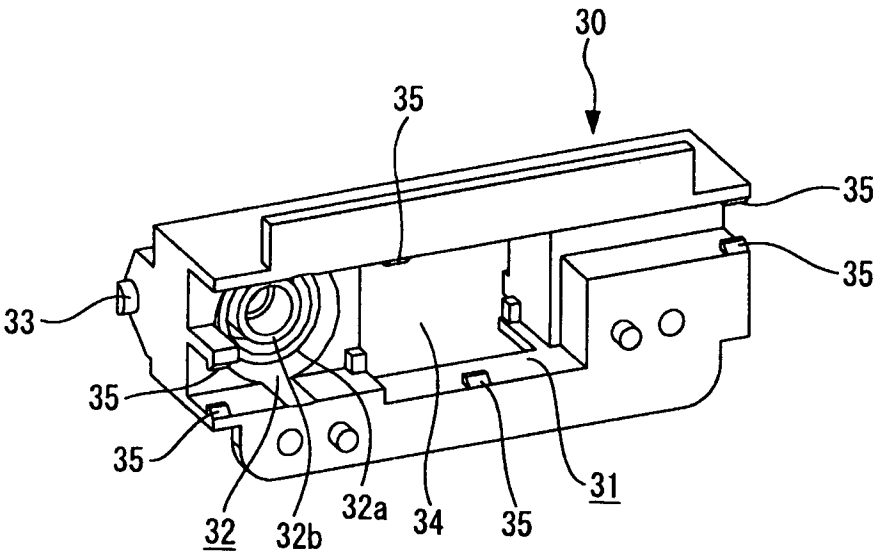
FIG. 7 is a perspective view showing a base member, as viewed obliquely from rear.

FIG. 7 is a perspective view showing the base member, as viewed obliquely from rear. FIG. 8A through FIG. 8D are views showing the rotor. A recess 31 for disposing slide pins extending from one side edge to the other side edge is formed on the rear side of the base member 30, and the proximal end parts of the respective slide pins 10 and 20 are slidably disposed in the recess 31 (Refer to FIG. 4) . Retaining projections 35 are formed at appropriate points in the base member 30, and the slide pins 10 and 20 are retained in the recess 31 by the retaining projections 35.

Further, a rotor installation part 32 is formed in the inner side deep in the recess 31. The rotor installation part 32 is configured so that two cylinders 32*a* and 32*b* are formed concentrically in the circular-cross-sectional recessed part (Refer to FIG. 7).

Figure 8B:
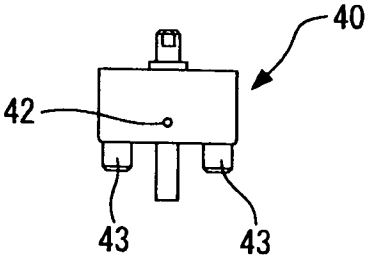
FIG. 8B is a plan view of the rotor.
Figure 8D:
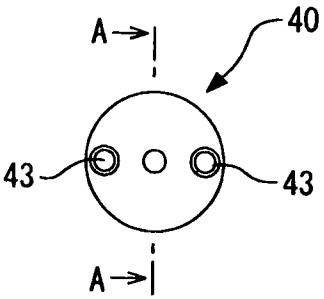
FIG. 8D is a front view of the rotor.
Figure 8A:
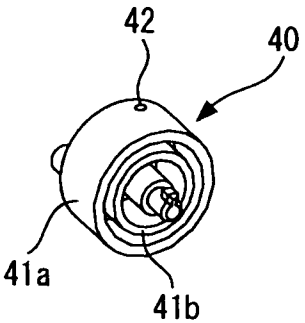
FIG. 8A is a perspective view of a rotor.
Figure 8C:
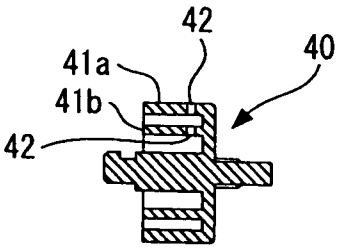
FIG. 8C is a sectional view taken along the A-A line of FIG. 8D.

On the other hand, as shown in FIG. 8A and FIG. 8C, the rotor 40 is formed into a cylindrical shape in which one end thereof opened, the other end thereof closed, and an inner cylinder 41*b* is concentrically locked in the hollow part thereof. The rotor 40 is installed in the rotor installation part 32 so that an outer cylinder 32*a* formed at the installation part 32 of the base member 30 is inserted between the outer cylinder 41*a* and the inner cylinder 41*b*. At this time, grease is supplied between the respective cylinders 41*a*, 41*b* of the rotor 40 and the outer cylinder 32*a* of the installation part 32 to provide viscosity resistance to rotations of the rotor 40. Thus, the rotor 40 is rotatably installed in the assembling part 32 of the base member 30.

Also, an air deflating hole 42 is drilled at a portion, in a normal state where the operation handle is not operated, positioned at the upper top part in the respective cylinders 41*a* and 41*b* of the rotor 40 (Refer to FIG. 8A through FIG. 8C). Even if air invades between the respective cylinders 41*a* and 41*b* into which grease is supplied, air that is lighter in weight than grease is finally deflated outside through the air deflating hole 42. In addition, grease the specific gravity of which is heavier than air never leaks through the air deflating hole 42 drilled at the upper top thereof. Further, since the rotor 40 is assembled at the rear side of the base member 30, there is an extremely rare case where the front side of the lid 1 will be stained by grease even if grease should leak out.

As shown in FIG. 8B through FIG. 8D, a pair of drive force transmission engagement parts 43,43 are formed at the end face of the rotor 40 so that the engagement parts 43, 43 protrude rearward. On the other hand, engaged parts 101 and 201 engaged with the drive force transmission engagement part 43, which are composed of a vertical groove, are formed at the proximal end part of the respective slide pins 10 and 20, respectively (Refer to FIG. 1). The respective slide pins 10 and 20 assembled in the rear side of the base member 30 are configured so that the engaged parts 101 and 201 thereof are separately engaged with one and the other of the pair of drive force transmission engagement parts 43, 43 provided at the rotor 40, respectively.

Figure 9C:
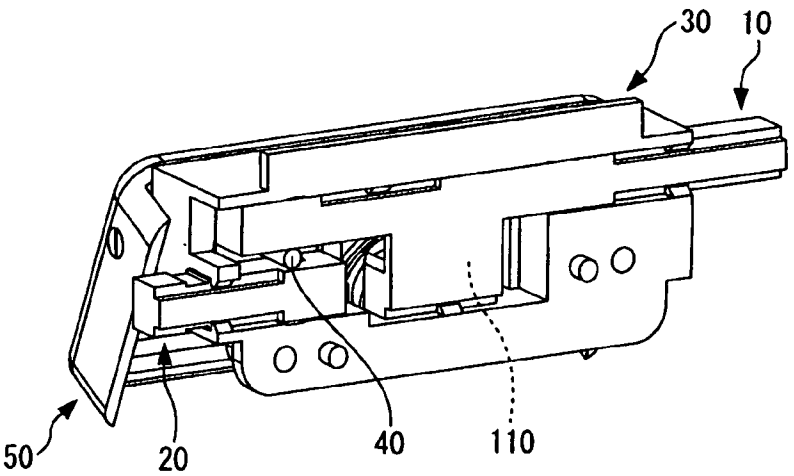
FIGS. 9A through 9D are explanatory views showing interlocked motions of respective slide pins by the rotor.
Figure 9D:
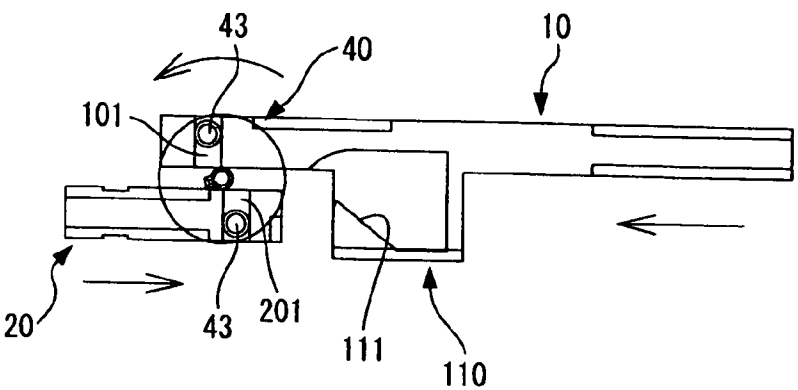
Figure 9A:
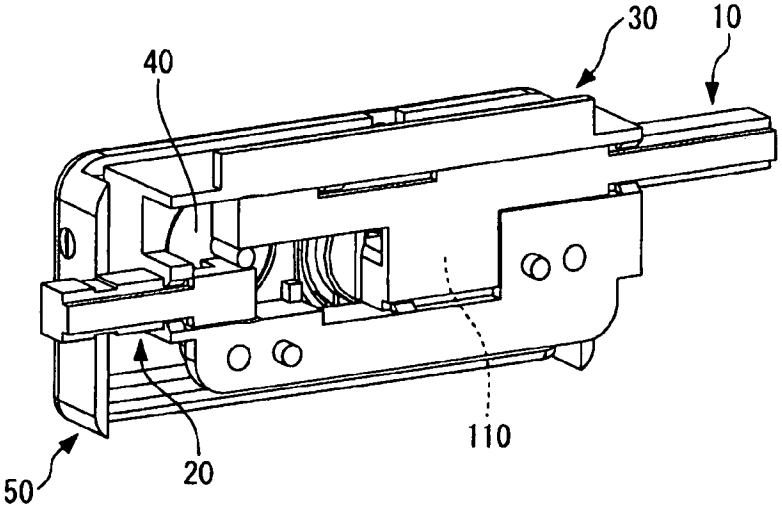
Figure 9B:
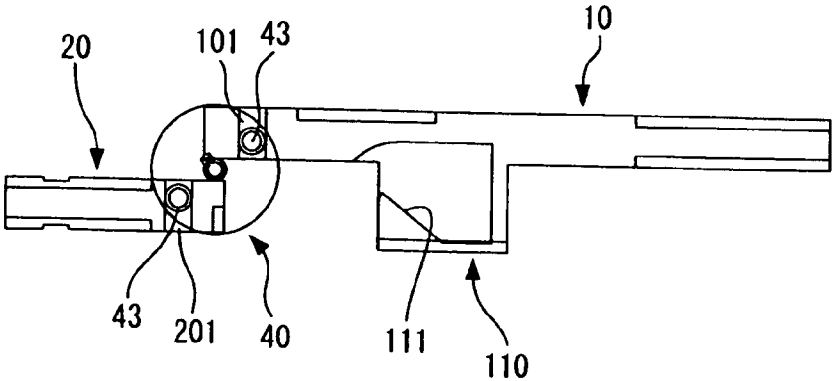

FIG. 9A through FIG. 9D are explanatory views describing interlocked motions of respective slide pins by the rotor. A state shown in FIG. 9A and FIG. 9B is a state where the tip ends of the respective slide pins 10 and 20 protrude from both side edges of the lid 1 and are engaged with the vehicle side locking part (not illustrated) (that is, a closed state of the lid 1). As shown in FIG. 9C and FIG. 9D, if the drive slide pin 10 is driven in the left direction of the same drawings from the above-described state, the drive force is converted to rotations of the rotor 40. In interlock therewith, the driven slide pin 20 engaged with the drive force transmission engagement part 43 of the rotor 40 is moved in the right direction of the same drawings. The moving directions of the respective slide pins 10 and 20 are directions in which the tip ends of the respective slide pins 10 and 20 are disengaged from the vehicle side locking part (not illustrated), and the lid is opened.

Figure 10:
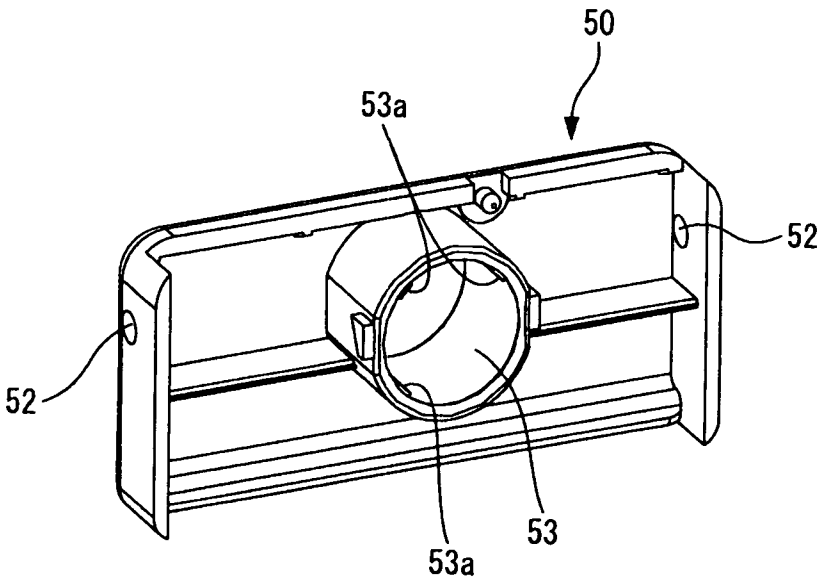
FIG. 10 is a view showing an operation handle.
Figure 11C:
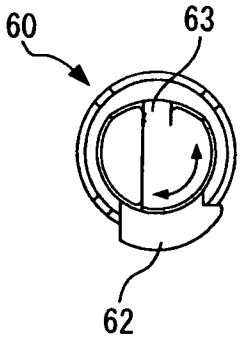
FIG. 11C is a rear view of the key cylinder.
Figure 11B:
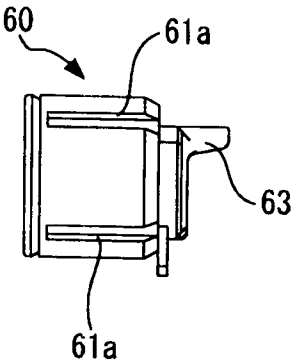
FIG. 11B is a side view of the key cylinder.
Figure 11A:
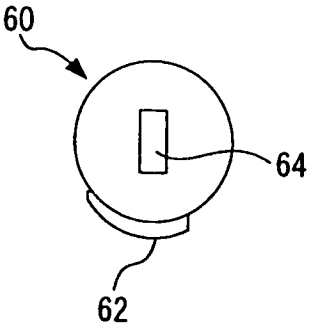
FIG. 11A is a front view of a key cylinder.

FIG. 10 is a view showing the operation handle, and FIG. 11A through FIG. 11C are views showing the key cylinder. The operation handle 50 is rotatably mounted at the front side of the base member 30 (Refer to FIG. 3). That is, a pair of supporting axes 33 and 33 that rotatably support the operation handle 50 are formed at both side faces of the base member 30 (Refer to FIG. 7). The supporting axes 33, 33 are fitted into the supporting holes 52 and 52 (Refer to FIG. 10) provided at both side faces of the operation handle 50. Also, a coil spring 51 is compressed and disposed between the operation handle 50 and the base member 30 (Refer to FIG. 1 through FIG. 4), and the operation handle 50 is urged so that the lower end edge always urged in the direction approaching the base member 30 side by the coil spring 51. The operation handle 50 may be turned by applying a finger top to the rear side of the operation handle 50 from downward.

As shown in FIG. 10, a fitting hole 53 of the key cylinder 60 is formed almost at approximately central part of the operation handle 50. The key cylinder 60 shown in FIG. 11A through FIG. 11C is fitted in the fitting hole 53. A plurality of guide projection rims 53*a* are formed on the inner circumferential surface of the fitting hole 53, and a plurality of recessed grooves 61*a* that are engaged with the guide projection rims 53*a* are formed on the outer circumferential surface of the key cylinder 60. The engagement piece 62 exposed in the diametrical direction from the rear end edge of the key cylinder 60 is urged by a spring member (not illustrated) , and is configured so as to resiliently protrude and retract inwardly in the diametrical direction.

Work for fitting the key cylinder 60 into the fitting hole 53 is carried out in a state where the locking piece 62 is pushed inwardly. The locking piece 62 that has been pushed in jumps out when the rear end face of the key cylinder 60 is exposed from the rear side of the fitting hole 53, and is then engaged with the rear side opening edge of the fitting hole 53. Accordingly, the key cylinder 60 is prevented from falling away.

As shown in FIG. 11B and FIG. 11C, the drive projection 63 protrudes rearward at the rear end face (backside) of the key cylinder 60. Also, a keyhole 64 is provided at the front side of the key cylinder 60. If a specified key is inserted into the keyhole 64 and is turned, the drive projection 63 also turns in interlock therewith.

As shown in FIG. 1 and FIG. 7, a penetration hole 34 passing from the front side to the rear side is formed at the middle part of the base member 30. The key cylinder 60 installed in the operation handle 50 is brought into the penetration hole 34 to prevent interference with the base member 30. In addition, the drive projection 63 protruding from the rear end face of the key cylinder 60 passes through the penetration hole 34 and is caused to protrude to the rear side of the base member 30.

On the other hand, as shown in FIG. 1, the drive force receiving part 110 for moving the tip end of the slide pin in the direction to be disengaged from the locking part at the vehicle side upon receiving an operation drive force from the operation handle 50 is formed at the proximal end part of the drive slide pin 10. The drive force receiving part 110 is configured so as to receive an operation drive force from the drive projection 63 in accordance with turning of the operation handle 50 and so as to convert the operation drive force to a force for causing the tip end of the drive slide pin 10 to move in the direction to be disengaged from the locking part (not illustrated) at the vehicle side.

FIG. 12A through FIG. 12C and FIG. 13A through FIG. 13C are views showing the relationship between the drive force receiving part of the drive slide pin and the drive projection at the operation handle side.

Figure 12A:
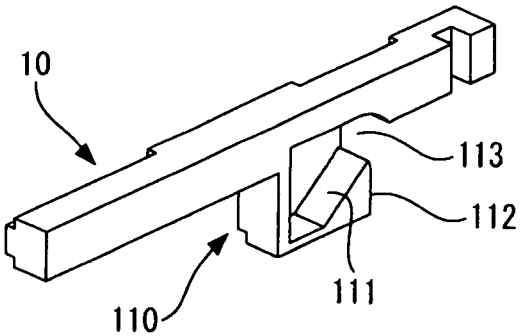
FIGS. 12A through 12C are views showing the relationship between a drive force receiving part of a drive slide pin and an drive projection at the operation handle side.
Figure 12B:
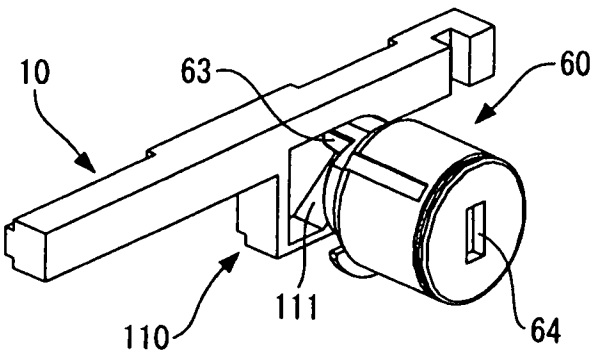
Figure 12C:
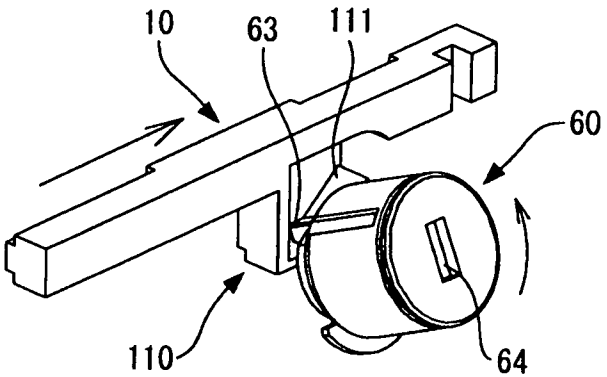

As shown in FIG. 12A through FIG. 12C, the inclination surface 111 is formed on the inside of the drive force receiving part 110 provided at the proximal end party of the drive slide pin 10, with which the drive projection 63 is brought into sliding contact, and which converts movement of the drive projection 63 in accordance with turning of the operation handle 50 to movement of the drive slide pin 10 in the lateral direction. That is, the drive projection 63 protruding from the rear end face of the key cylinder 60 is brought into contact with the inclination surface 111 of the drive force receiving part 110 in accordance with turning of the operation handle 50, and presses the inclination surface 111 from upward (Refer to FIG. 12C). A horizontal component of the pressing force with respect to the inclination surface 111 causes the drive slide pin 10 to move in the lateral direction. At this time, the moving direction of the drive slide pin 10 becomes a direction to disengage the tip end of the drive slide pin 10 from the locking part (not illustrated) at the vehicle side.

Further, the bottom face of the drive force receiving part 110 is in contact with the floor face of the recess 31 of the base member 30 (Refer to FIG. 4), wherein the operation drive force transmitted from the drive projection 63 to the inclination surface 111 can be accepted on the floor face of the recess 31 of the base member 30 and a sufficient strength against the operation drive force can be maintained.

Figure 13C:
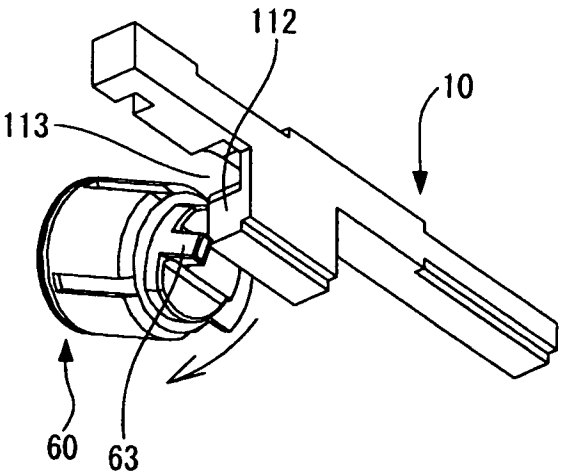
FIGS. 13A through 13C also are views showing the relationship between a drive force receiving part of a drive slide pin and a drive projection at the operation handle side.
Figure 13B:
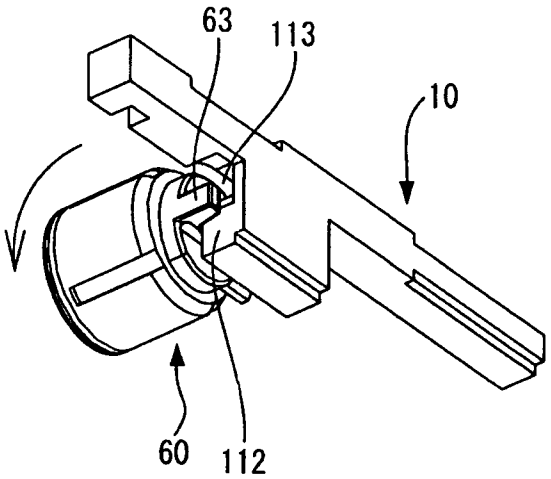
Figure 13A:
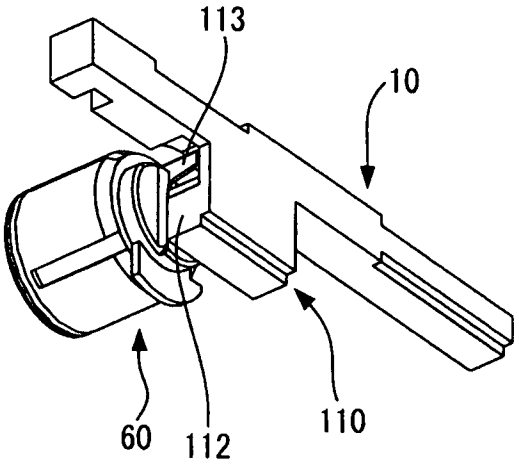

Also, as shown in FIG. 13A through FIG. 13C, in accordance with drive operations of the operation handle 50, the drive projection 63 protruding from the rear end face of the key cylinder 60 can be selectively movable by turning operations of the key cylinder 60 between the drive position (Refer to FIG. 13A) where the drive projection 63 is brought into sliding contact with the inclination surface 111 of the drive force receiving part 110 and the non-drive position (the positions of FIG. 13B and FIG. 13C) where the drive projection 63 is not brought into contact with the inclination surface 111 of the drive force receiving part 110 even if the operation handle 50 is operated for drive.

If the drive force receiving part 110 is disposed at the non-drive position, the operation drive force is not transmitted to the drive slide pin 10 even if the operation handle 50 is operated. Therefore, a closed state of the lid 1 may be retained.

Here, one outer side face of the drive force receiving part 110 forms a movement regulating side face 112. That is, as shown in FIG. 13B and FIG. 13C, the drive projection 63 located at the non-drive position is brought into contact with the movement regulating side face 112, and the tip end of the drive slide pin 10 regulates movement of the drive slide pin 10 in the direction to be disengaged from the vehicle side locking part (not illustrated). Therefore, it is possible to further securely maintain a closed state of the lid 1.

Also, a notched part 113 is formed between the inclination surface 111 of the drive force receiving part 110 and the movement regulating side face 112, and the moving track of the drive projection 63 is secured through the notched part 113.

Figure 14:
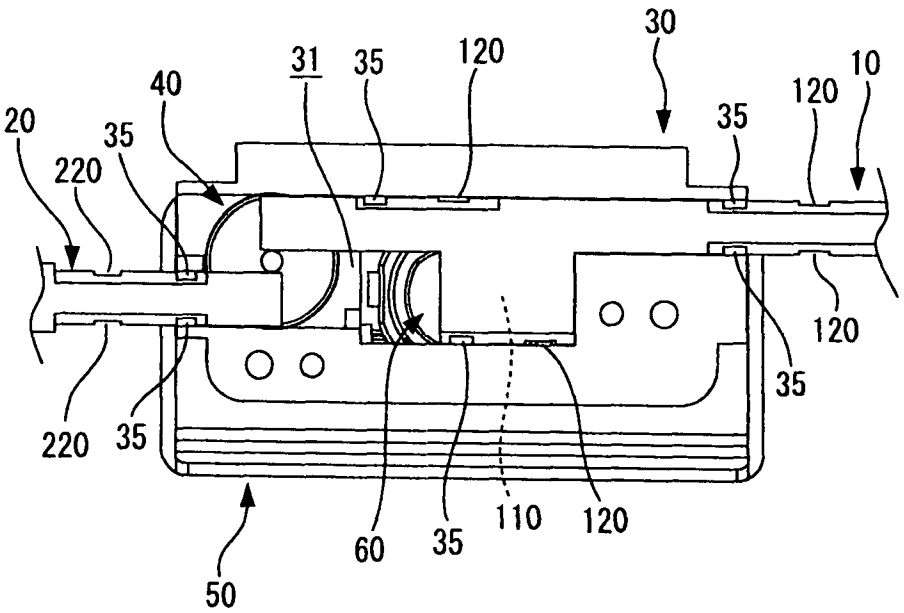
FIG. 14 is a view showing the rear side of a base member in a state where the respective slide pins are installed.

FIG. 14 is a view showing the rear side of the base member in which the respective slide pins are installed.

As shown in the same drawing, installation recessed parts 120 and 220 are formed at appropriate points in the respective slide pins 10 and 20. The forming positions of these installation recessed parts 120 and 220 are the positions corresponding to the retaining projections 35 in a state where the respective slide pins 10 and 20 are moved beyond the range driven by the operation handle 50. The installation recessed parts 120 and 220 are aligned to the positions opposing the retaining projections 35, and the slide pins 10 and 20 are pushed in the recess 31 of the base member 30 at the positions, wherein the respective slide pins 10 and 20 can be installed in the base member 30.

Also, as shown in FIG. 14 and FIG. 7, the rotor installation part 32 in the base member 30 is formed sideways in one direction from the middle part in the width direction. And, the drive force receiving part 110 of the drive slide pin 10 is formed sideways in the other direction not interfering with the rotor installation part 32.

Therefore, the supporting range by the base member 30 with respect to the drive slide pin 10 that receives an operation drive force from the operation handle 50 can be further extended than in the drive slide pin 20. Accordingly, it becomes possible to compensate smooth movement with the drive slide pin 10 appropriately supported.

Figure 15:
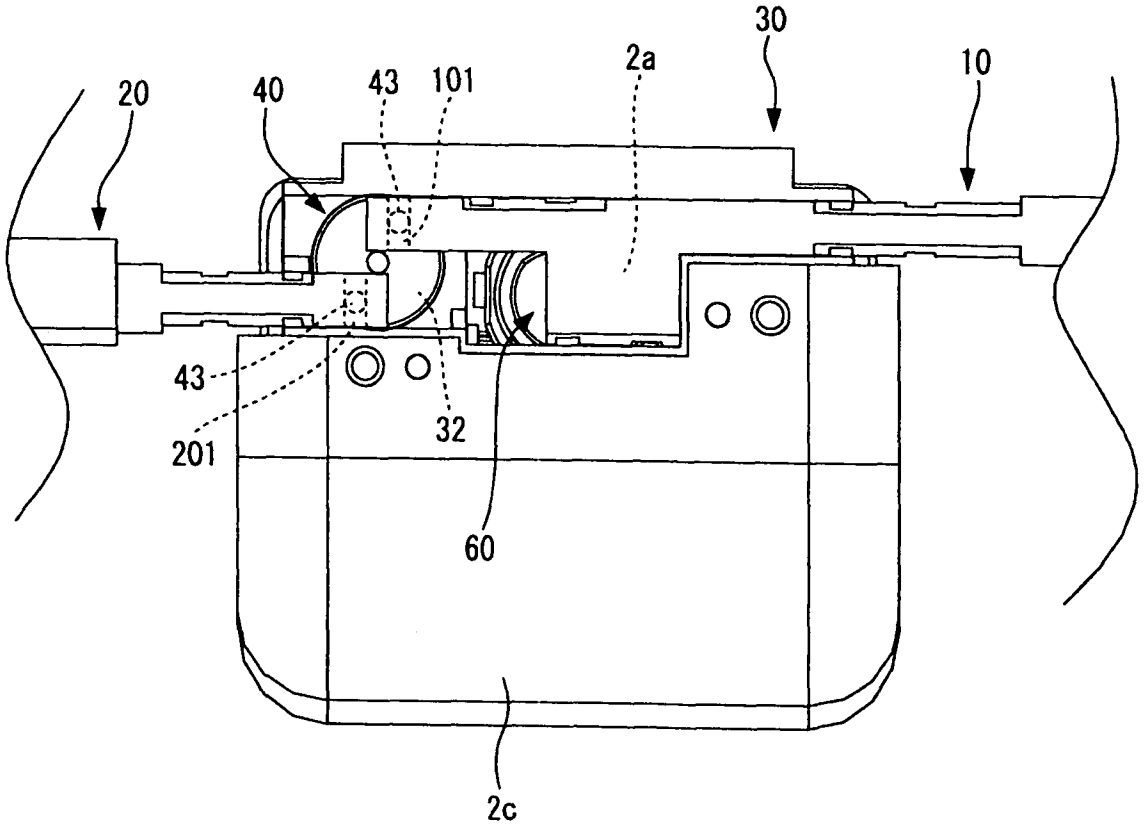
FIG. 15 is a rear view showing a state where a side-lock device according to the first embodiment of the present invention is installed in a lid.

FIG. 15 is a rear view showing a state where a side-lock device according to the present embodiment is installed in a lid.

As shown in FIG. 5, the installation part 2 of the side-lock device, which is formed on the lid 1, has an opening area 2*a* passing through the lid 1 from its surface to its rear side. And, an operation space 2*b* through which a hand is inserted to the rear side of the operation handle 50 is formed at an area downward of the opening area 2*a*. Rearward of the operation space is partitioned by the partition 2*c*.

The base member 30 is installed in the lid 1 through the front side and is tightened to the partition 2*c*. At this time, the rotor installation part 32 is disposed at the opening area 2*a* of the lid 1 (Refer to FIG. 15) . Therefore, the drive force transmission engagement part 43 of the rotor 40 is exposed to the rear side of the lid 1 through the opening area 2*a*, and enables to engage the engaged parts 101 and 201 of the respective slide pins 10 and 20 from the rear side of the lid 1.

Thus, since the drive force transmission engagement part 43 of the rotor 40, which causes the respective slide pins 10 and 20 to engage, is exposed to the rear side of the lid 1, the base member 30 in which the rotor 40 is installed can be easily assembled to the lid 1 from the surface side without any hindrance, and further since engagement work of the respective slide pins 10 and 20 with the drive force transmission engagement part 43 can be carried out from the rear side of the lid 1 whose periphery is opened, such engagement work can be facilitated, and the work can be further facilitated as an entirety.

As shown in FIG. 6, since the respective slide pins 10 and 20 are caused to pass through the supporting holes 5 and 6 provided on the rear side of the lid 1 and supported therein, the tip ends thereof are urged in the direction protruding from both side edges at all times by means of the coil springs 11 and 21. Therefore, when the operation handle 50 is not operated, the tip ends of the slide pins 10 and 20 are engaged with the locking part (not illustrated) at the vehicle side and maintain the lid 1 in a closed state.

As shown in FIG. 6, the first backlash preventing part 130 for preventing backlash in the forward and backward directions of the slide pin 10 and the second backlash preventing part 140 for preventing backlash in the up and down directions of the slide pin 10 are provided at the intermediate part of the drive slide pin 10. A resilient piece 131 for urging the first projection piece 3 (Refer to FIG. 5) provided on the rear side of the lid 1 in the forward and backward directions of the slide pin 10 is provided at the first backlash preventing part 130 (Refer to FIG. 1). In addition, a pair of resilient pieces 141, 141 for retaining to urge the second projection piece 4 (Refer to FIG. 5) provided on the rear side of the lid 1 in the up and down directions are provided at the second backlash preventing part 140 (Refer to FIG. 1).

Second Embodiment

Next, with reference to FIG. 16 through FIG. 25C, a detailed description is given of a side-lock device according to the second embodiment of the present invention. Also, in the present embodiment, components that are identical or equivalent to those of the side-lock device according to the first embodiment previously shown are given the same reference numerals, and a detailed description of the components may be omitted.

Figure 16:
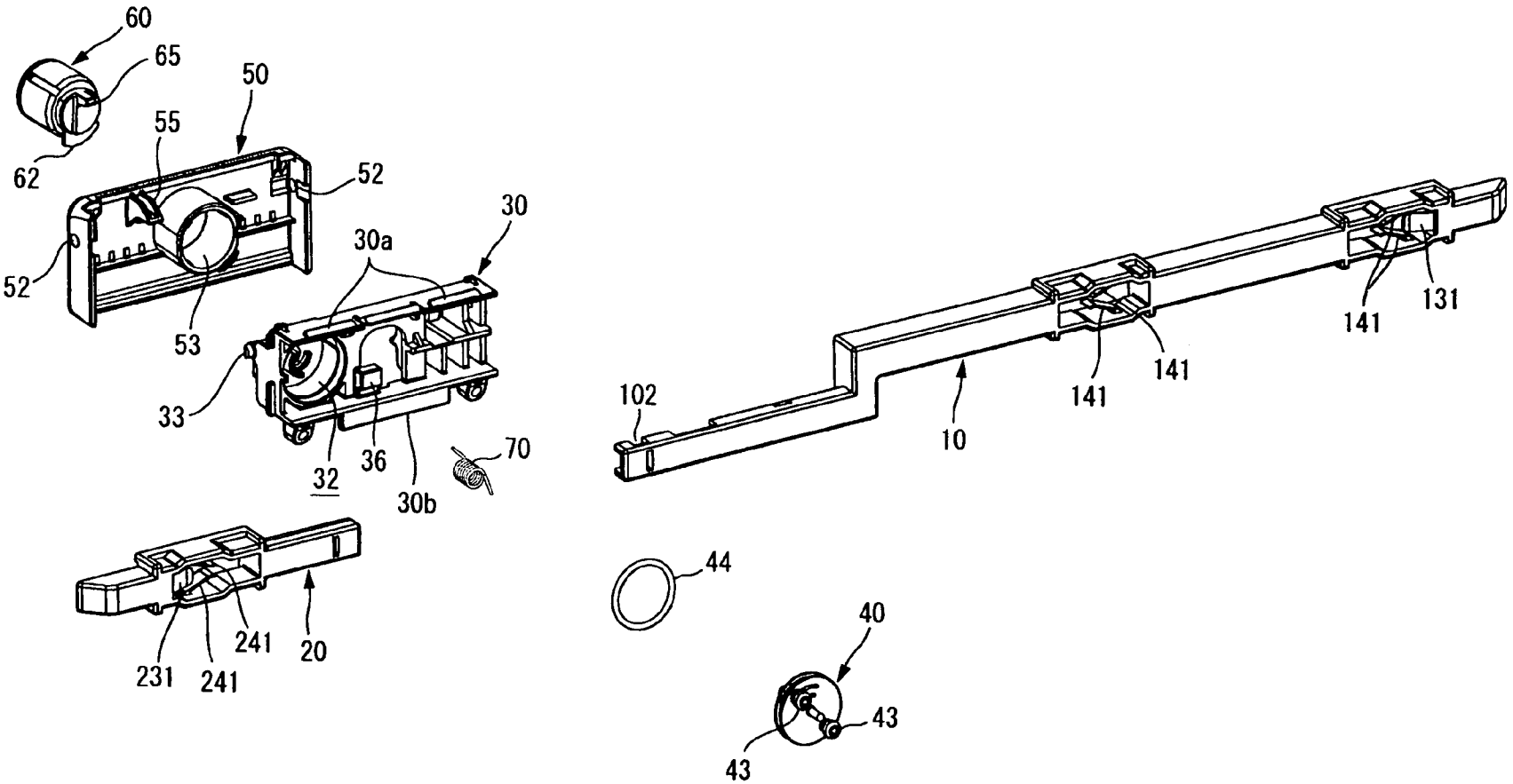
FIG. 16 is a disassembled perspective view showing respective components of a side-lock device according to the second embodiment of the present invention, as viewed obliquely from rear.
Figure 17:
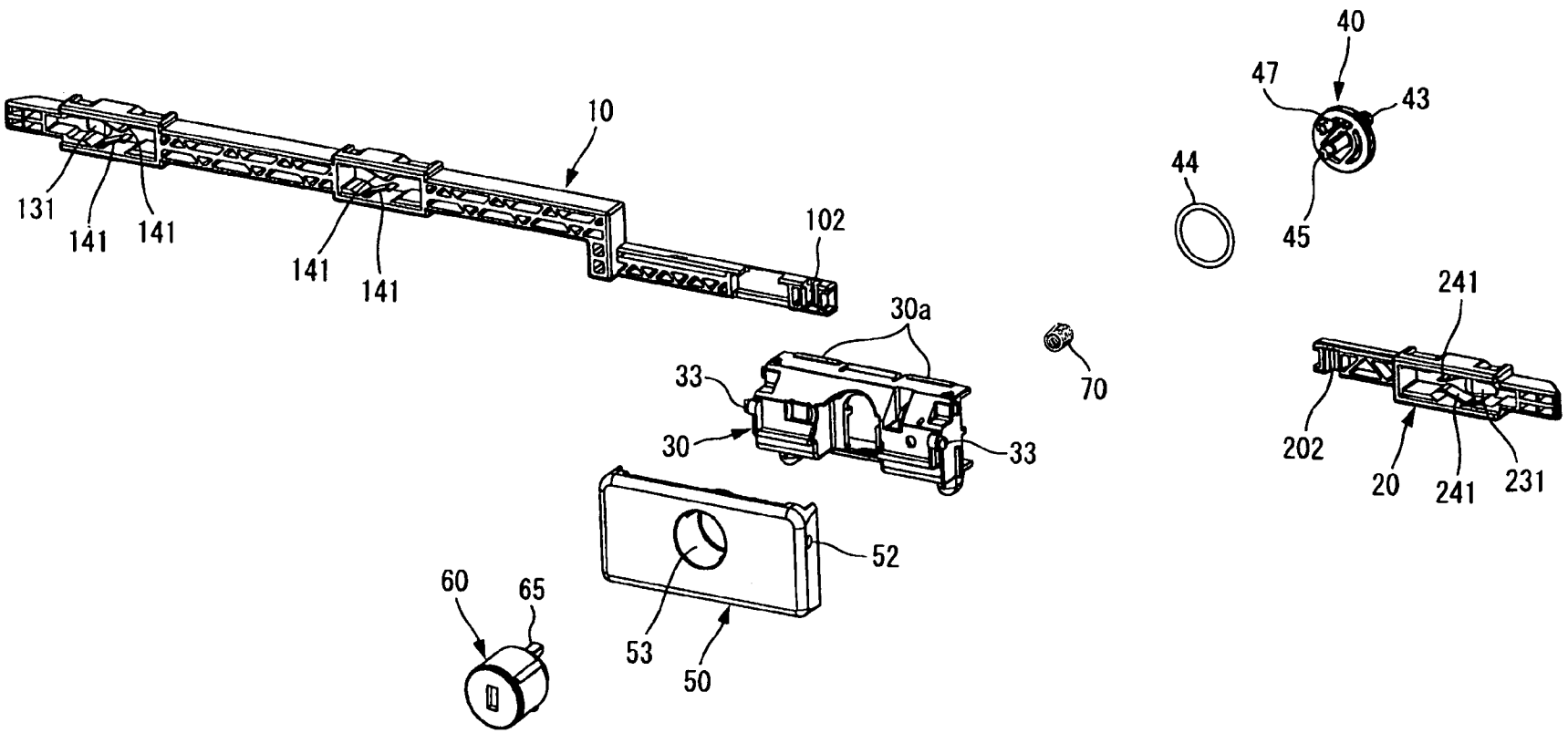
FIG. 17 is a disassembled perspective view showing respective components of a side-lock device according to the second embodiment of the present invention, as viewed obliquely from front.

As shown in FIG. 16 and FIG. 17, a side-lock device according to the present embodiment is provided with a pair of left and right slide pins 10, 20, a base member 30, a rotor 40, an operation handle 50, a key cylinder 60, and a torsion coil spring 70 as the components thereof.

The present embodiment is configured so that the rotor 40 receives an operation drive force from the operation handle 50 as described later, and a pair of left and right slide pins 10 and 20 are caused to move by interlocking with turning of the rotor 40. Therefore, there is no relationship of driving and being driven with respect to the respective slide pins 10 and 20.

The respective components are assembled as described below. That is, the rotor 40 is assembled after the torsion coil spring 70 is inserted and disposed in the rotor installation part 32 of the base member 30 from the rear side. Such a configuration is adopted so that an O-ring 44 is fitted to the outer circumferential edge in the rotor 40, wherein the O-ring 44 is brought into contact with the inner-circumferential surface of the rotor installation part 32, and turning of the rotor 40 is controlled by friction resistance therebetween. Therefore, in the present embodiment, it is not necessary to fill grease in the rotor installation part 32 as in the first embodiment described above.

The torsion coil spring 70 has a function of urging the rotor 40 and returning the operation handle 50 from an operated position to its original position and a function of retaining a state where the respective slide pins 10 and 20 protrude from both end edges of the lid, respectively. That is, the torsion coil spring 70 concurrently has functions of the coil springs 51, 11 and 21 in the first embodiment described before.

The operation handle 50 is rotatably mounted on the surface side of the base member 30. The key cylinder 60 is assembled to the operation handle 50 from the surface side thereof.

Figure 18A:
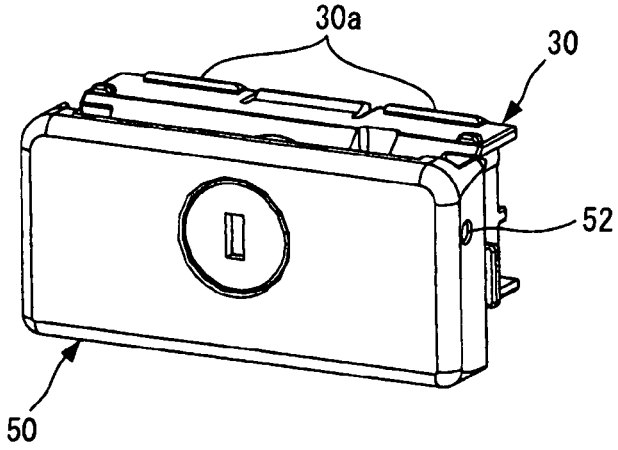
FIGS. 18A through 18C are perspective views showing a state where respective components (excluding the slide pins) of a side-lock device according to the second embodiment of the invention are assembled.
Figure 18B:
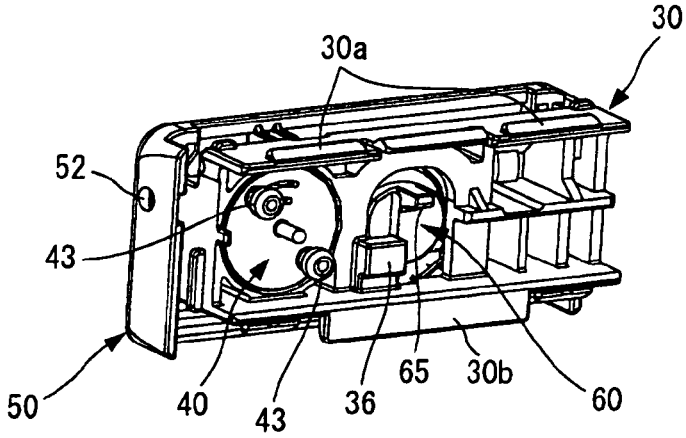
Figure 18C:
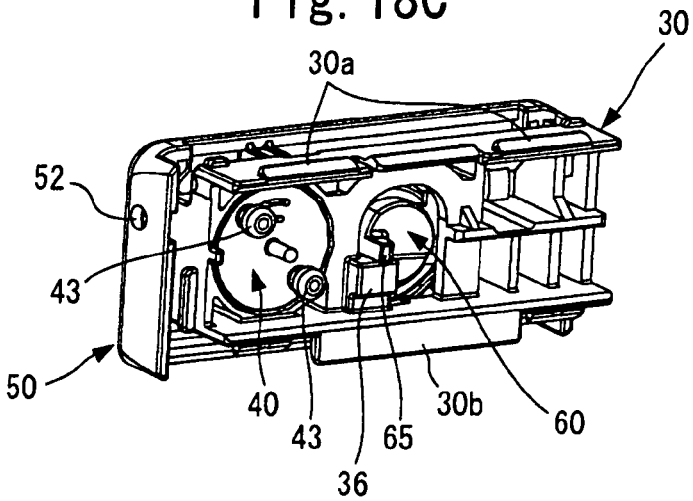

FIG. 18A through FIG. 18C are perspective views showing a state where the respective components other than the slide pins are assembled to a base member.

In the present embodiment, a locking wall 36 is formed on the rear side of the base member 30. When the key cylinder 60 is turned to the locking position, the locking projection 65 protruding form the rear side of the key cylinder 60 moves to the position interfering with the locking wall 36 (Refer to FIG. 18C). Even if the operation handle 50 is attempted to be turned when the locking projection 65 exists at the position, the locking projection 65 is brought into contact with the locking wall 36 and the turning operation is not able to be carried out. That is, the operation handle 50 is in a locked state. On the other hand, FIG. 18B shows a state where the locking is cancelled. In this state, since the locking projection 65 is at the position not interfering with the locking wall 36, there is no case where the locking projection 65 is brought into contact with the locking wall 36 even if the operation handle 50 is turned.

In addition, although the locking projection 65 is called a drive projection 63 in the first embodiment described above, the component is not given a function for driving the slide pin 10 in the present embodiment.

Figure 19:
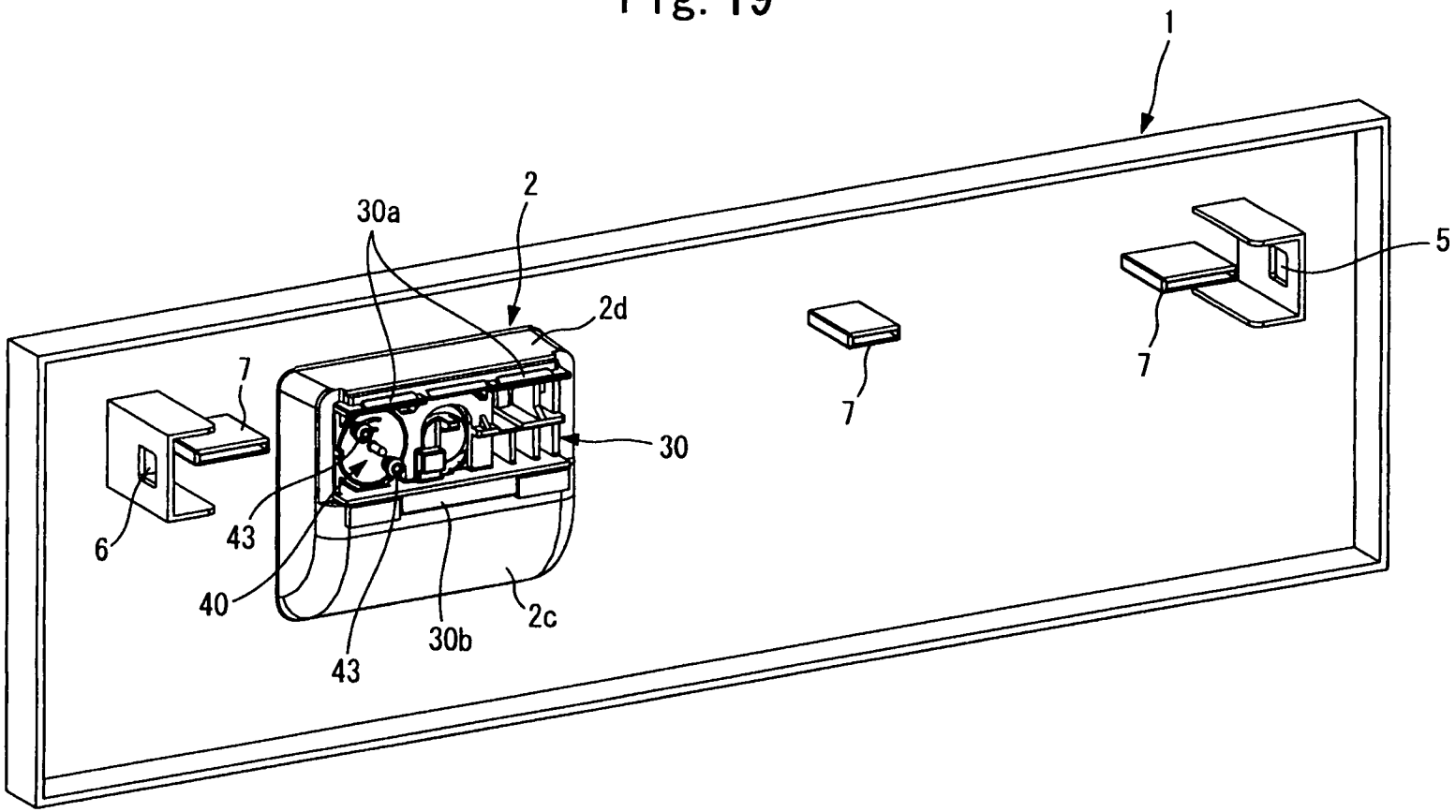
FIG. 19 is a perspective view showing a state where a side-lock device (excluding the slide pins) according to the second embodiment of the present invention is assembled in a lid.

FIG. 19 is a perspective view showing a state, where the side-lock device is installed in the installation part of the side-lock device formed on the lid, from the rear side thereof.

In the present embodiment, the upper end edge of the partition 2*c* formed at the installation part of the side-lock device in the lid 1 is shaped to be linear, and the engagement wall 2*d* is formed at an upward position opposed to the upper end edge of the partition 2*c*.

Figure 20:
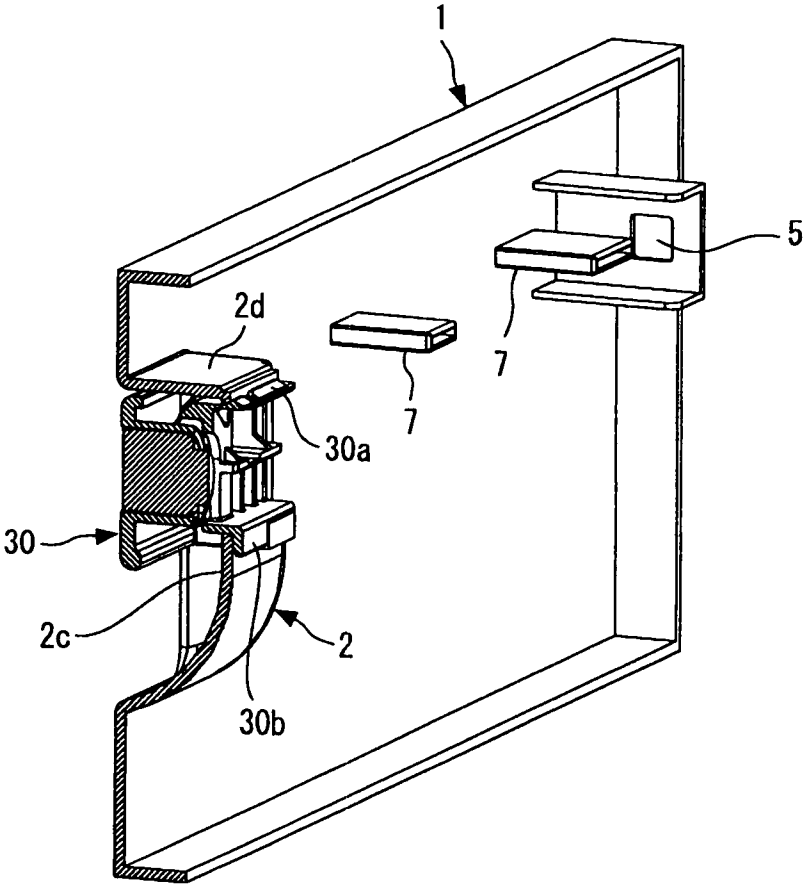
FIG. 20 is a perspective view showing an assembled state of a base member in a lid with a part thereof notched.

Mounting-locking pieces 30*a* and 30*b* are formed at the upper and lower positions on the rear side in the base member 30, respectively. As shown in FIG. 20, first, the lower mounting-locking piece 30*b* is caught at the upper end edge of the partition 2*c*, and the upper mounting-locking piece 30*a* is next engaged with the engagement wall 2*d*. Therefore, the side-lock device 1 can be easily installed in the lid 1 without necessity to prepare any fastenings such as screws, etc.

Figure 21:
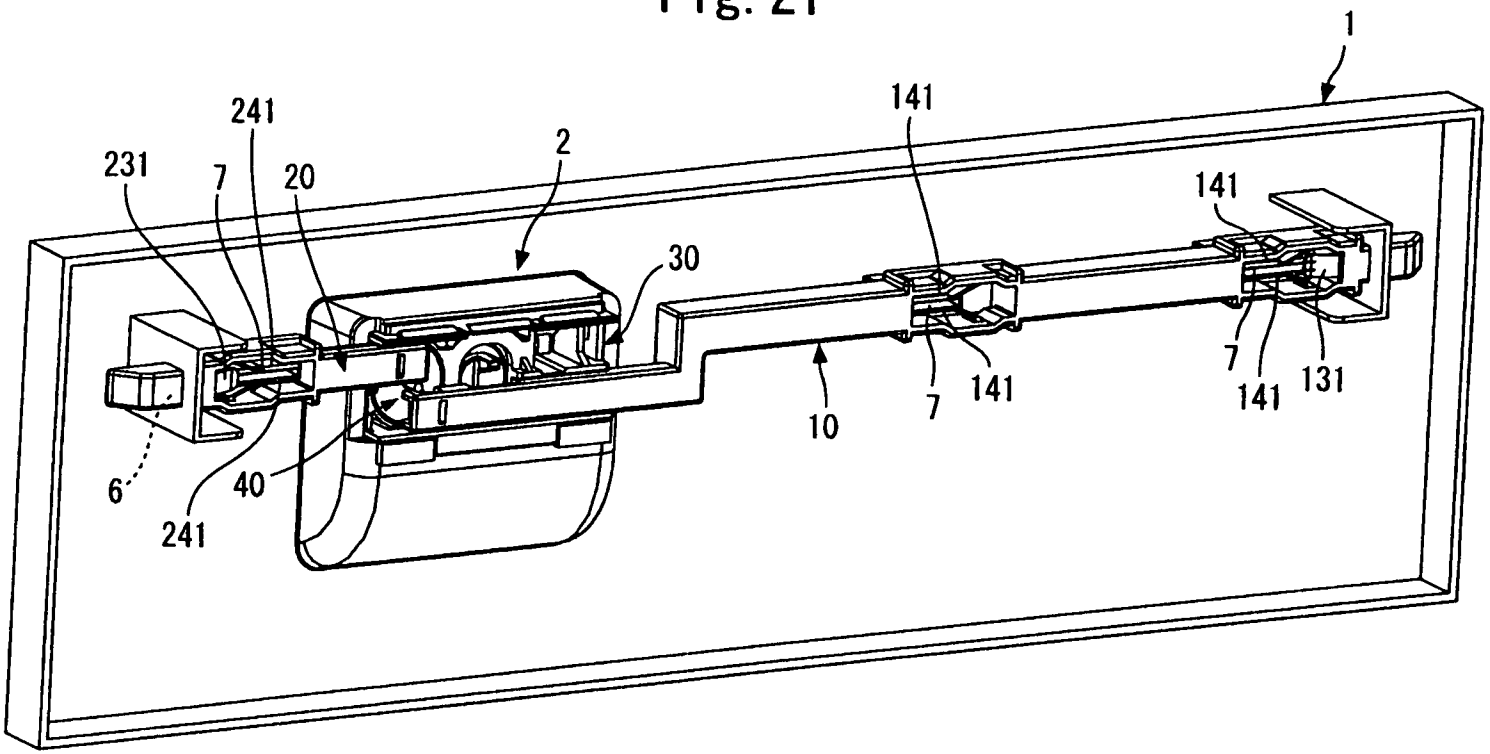
FIG. 21 is a perspective view showing a state where a side-lock device (including the slide pins) according to the second embodiment of the present invention is assembled in a lid.

FIG. 21 is a perspective view showing, from the rear side, a state where respective slide pins are engaged with the rotor of the side-lock device installed in the lid.

In the present embodiment, the respective drive force transmission engagement parts 43, 43 of the rotor 40 are exposed to the rear side of the lid 1. Therefore, engagement work of the respective slide pins 10 and 20 with the respective drive force transmission engagement parts 43 and 43 can be easily carried out from the rear side of the lid 1.

Figure 22A:
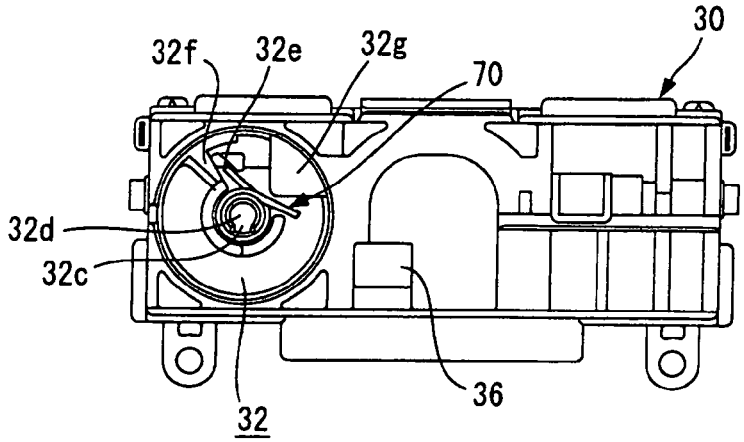
FIG. 22A is a view showing a base member in which a torsion coil spring is disposed.
Figure 22B:
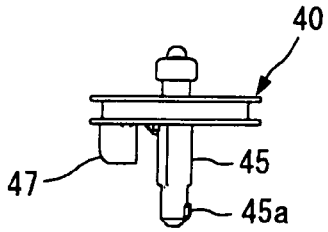
FIG. 22B through FIG. 22D are views showing the configuration of a rotor.
Figure 22C:
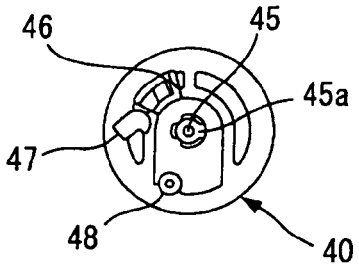
Figure 22D:
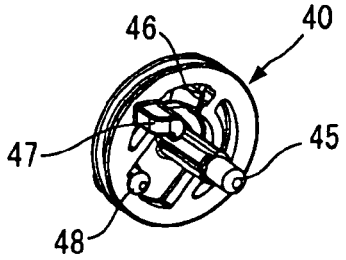

FIG. 22A is a view showing a base member in which a torsion coil spring is disposed, and FIG. 22B through FIG. 22D are views showing the configuration of the rotor.

Next, with reference to these drawings, a description is given of an assembling structure of the rotor 40 in the base member 30.

As shown in FIG. 22A, an assembling hole 32*d* having a key groove 32*c*, a spring locking part 32*e* for locking one end of the torsion coil spring 70, a stopper wall 32*f*, and an insertion window 32*g* for inserting the drive projection 55 (Refer to FIG. 16) of the operation handle 50 are formed in the assembling part 32 of the rotor 40 formed in the base member 30.

Also, as shown in FIG. 22B through FIG. 22D, a supporting axis 45 that becomes the center of rotation, a contacting claw 46 (contacting part) that is brought into contact with the stopper wall 32*f*, a drive force receiving part 47 that receives an operation drive force from the operation handle 50, and a spring force receiving part 48 that is engaged with the other end of the torsion coil spring 70 and receives the spring urging force are formed at the rotor 40.

The torsion coil spring 70 is disposed at the periphery of the assembling hole 32*d* in a state where one end thereof is locked at the spring locking part 32*e* (Refer to FIG. 22A) . In this state, the tip end part of the supporting axis 45 of the rotor 40 is inserted into the assembling hole 32*d*. Here, a key projection rim 45*a* is formed on the peripheral surface of the supporting axis 45. The forming positions and forming angles of the respective parts are adjusted so that, by aligning the key projection rim 45*a* with the key groove 32*c* of the assembling hole 32*d*, the spring force receiving part 48 of the rotor 40 is disposed at a position where the spring force receiving part 48 is engaged with the other end of the torsion coil spring 70. That is, the key groove 32*c* and the key projection rim 45*a* composes a position-aligning portion where the spring force receiving part 48 is disposed at a position where the spring force receiving part 48 can be engaged with the torsion coil spring 70 when mounting the rotor 40 at the base member 30.

If the supporting axis 45 is inserted into the assembling hole 32*d* with the key projection rim 45*a* aligned in the key groove 32*c*, the contacting claw 46 is disposed at a position immediately before climbing over the stopper wall 32*f*. If the rotor 40 is turned clockwise of FIG. 22A from the position, the contacting claw 46 is resiliently bent and climbs over the stopper wall 32*f*. At this time, the other end of the torsion coil spring 70 is engaged with the spring force receiving part 48 of the rotor 40, a urging force is given to the rotor 40. With the urging force, the rotor 40 turns counterclockwise of FIG. 22A, and the contacting claw 46 is brought into contact with the stopper wall 32*f*.

Although the contacting claw 46 is resiliently bent with respect to the stopper wall 32*f* and climbs over the same by movement in the clockwise direction in FIG. 22A, the contacting claw 46 is brought into contact with the stopper wall 32*f* without being bent by movement in the counterclockwise direction in the same drawing, and regulates turning of the rotor 40.

Figure 23A:
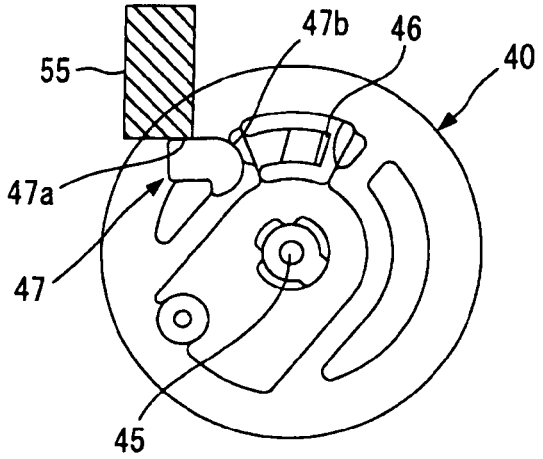
FIGS. 23A through 23C are views showing the relationship between a drive projection of an operation handle and a drive force receiving part of a rotor.

In a state where the contacting claw 46 is in contact with the stopper wall 32*f*, the drive force receiving part 47 formed in the rotor 40 is disposed at an appropriate position that is brought into contact with the drive projection 55 of the operation handle assembled thereafter (the disposed position corresponds to a position slightly rotated in the figure-based clockwise direction from the position of FIG. 23A shown later).

Thus, the stopper wall and the contacting claw have a function that regulates turning of the rotor 40 against the urging force of the torsion coil spring 70 and, with the regulation for turning, disposes the drive force receiving part of the rotor 40 at the position with which the drive projection 55 is brought into contact when mounting the operation handle 50 in the base member 30.

Figure 23B:
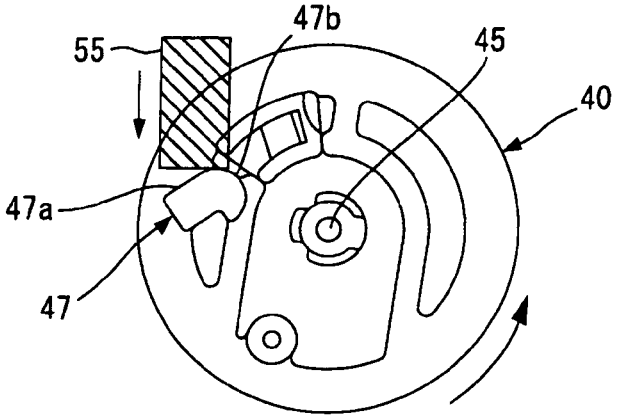
Figure 23C:
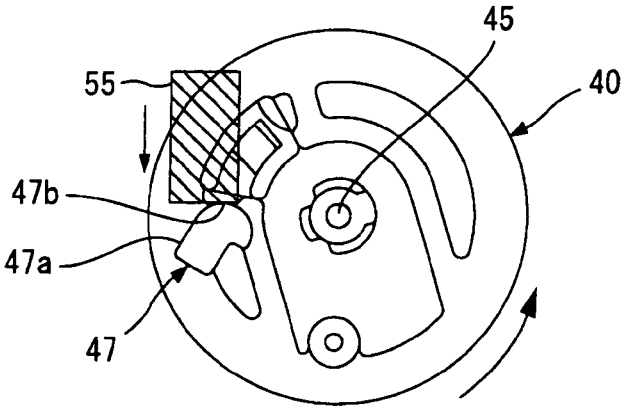

FIG. 23A through FIG. 23C are views showing the relationship between the drive projection of the operation handle and the drive force receiving part of the rotor.

FIG. 23A shows a state where the operation handle 50 is not operated. When the operation handle 50 is installed in the base member 30, the contacting claw 46 is brought into contact with the stopper wall 32*f* as already described, and the drive force receiving part 47 of the rotor 40 is disposed at the position shown in the same drawing. At this time, the rotor 40 slightly rotates in the figure-based counterclockwise direction, and the contacting claw 46 separates from the stopper wall 32*f* (Refer to FIG. 22A). Subsequently, if the operation handle 50 is installed in the base member 30, the drive projection 55 (Refer to FIG. 16) that is inserted through the insertion window 32*g* (Refer to FIG. 22A) is brought into contact with the drive force receiving part 47.

Here, the drive force receiving part 47 of the rotor 40 is composed of an extension area 47*a* with which the drive projection 55 is brought into contact in a state where the operation handle 50 is not operated (Refer to FIG. 23), and an arcuate face area 47*b* with which the drive projection 55 is brought into contact in the process in which the operation handle 50 is turned for operation (Refer to FIG. 23B through FIG. 23C). Thus, since the area 47*b* with which the drive projection 55 is brought into contact in the process in which the operation handle 50 is turned for operation is made into an arcuate face, the contact resistance between the drive force receiving part 47 and the drive projection 55 is reduced, thereby enabling smooth rotations of the rotor 40.

Also, the arcuate face area 47*b* is formed closer to the center of rotation of the rotor 40 than the extension area 47*a*. On the other hand, the extension area 47*a* is formed continuously to the arcuate face area 47*b* so as to extend in the tangential direction of the arcuate face area 47*b* and in the direction of parting from the center of rotation of the rotor 40. If the extension area 47*a* is extended to the position apart from the center of rotation of the rotor 40, and the drive projection 55 is brought into contact therewith, a great torque for the rotor 40 can be obtained by merely applying a small operation force to the operation handle 50 at the beginning of operation of the operation handle 50, wherein favorable maneuverability of the operation handle 50 can be brought about.

Figure 24:
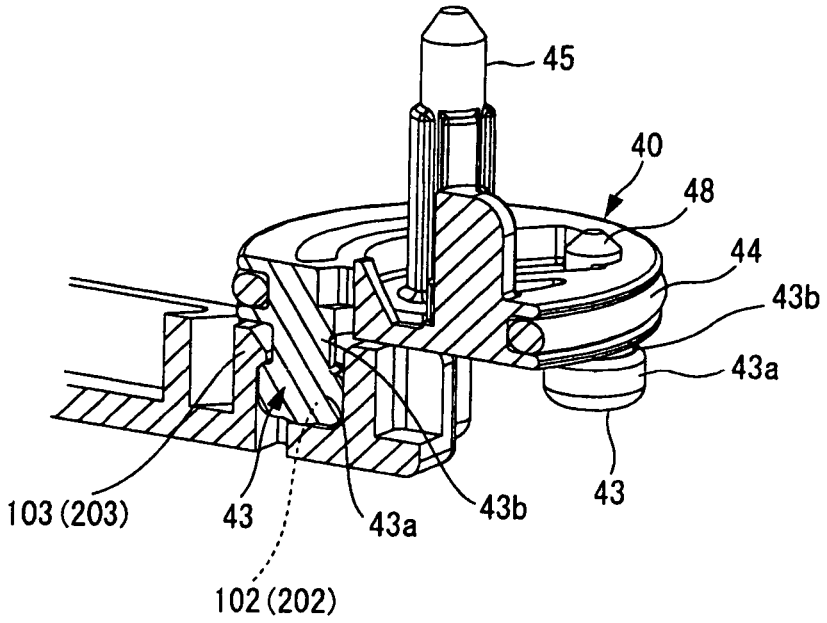
FIG. 24 is a view showing the relationship between a drive force transmission engagement part of a rotor and an engaged part of the slide pin engaged therewith.

FIG. 24 is a view showing the relationship between the drive force transmission engagement part of the rotor and the engaged part of the slide pin engaged therewith.

The drive force transmission engagement parts 43 and 43 of the rotor 40 are formed to be a columnar projection having a head portion 43*a* whose diameter is greater than that of the body part 43*b*. Also, the engaged parts of the slide pins 10 and 20 are formed of recessed parts 102, 202 to be fitted to the head portions of the drive force transmission engagement parts 43, 43. Locking claws 103 and 203 resiliently engaged with the head portions 43*a* of the drive force transmission engagement parts 43 and 43 are formed at one part of the sidewall that forms the recessed parts 102 and 202. Since the locking claws 103 and 203 are meshed with and engaged with the head portions 43*a* of the drive force transmission engagement parts 43 and 43, the slide pins 10 and 20 are retained at the rotor 40. That is, a retaining structure to retain the slide pins 10 and 20 at the rotor 40 is configured between the drive force transmission engagement parts 43 and 43 of the rotor 40 and the engaged parts of the slide pins 10 and 20. Therefore, in the present embodiment, the retaining projection 35 (Refer to FIG. 7) of the base member 30 in the first embodiment is no longer required.

Figure 25A:
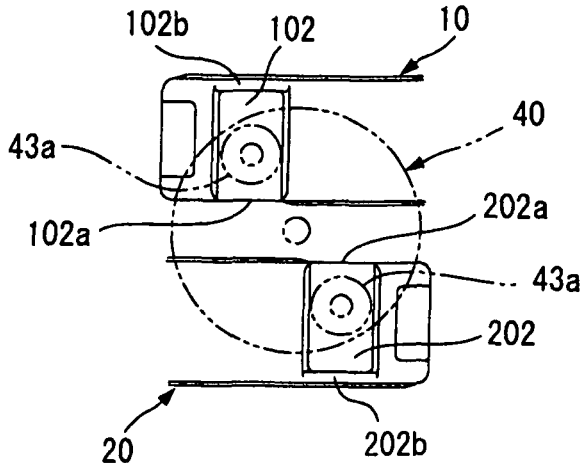
FIGS. 25A through 25C are explanatory views describing a recessed part structure of the slide pins.
Figure 25B:
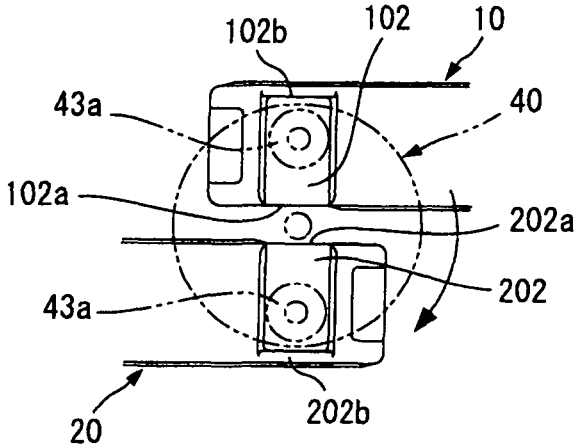
Figure 25C:
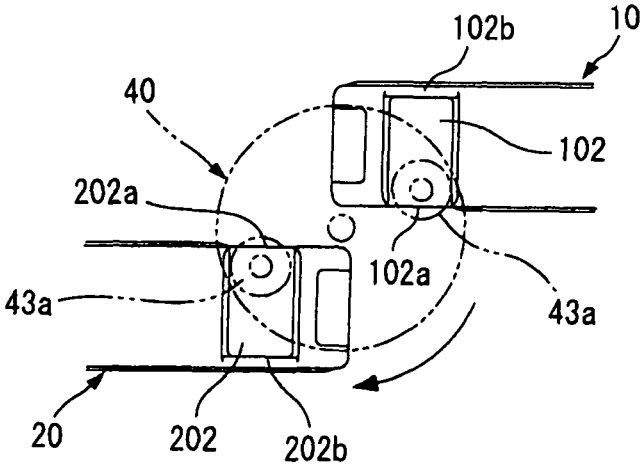

FIG. 25A through FIG. 25C are explanatory views describing the recessed structure of the slide pins.

When receiving an operation drive force from the operation handle 50, the rotor 40 turns in the range shown from FIG. 25A to FIG. 25C. Here, in the state shown in FIG. 25C, the head portion 43*a* of the drive force transmission engagement part 43 formed at the rotor 40 is partially exposed beyond the inner side face of the recessed parts 102 and 202. Thus, at the side face of the recessed parts 102 and 202 where the head portion 43*a* of the drive force transmission parts 43 and 43 may be partially exposed, openings 102*a* and 202*a* are formed. On the other hand, on the inner side face opposed to the openings 102*a* and 202*a*, the reinforcement walls 102*b* and 202*b* are formed. Therefore, the rigidity of the portions where the recessed parts 102 and 202 are formed is increased, wherein the engaged state of the slide pins 10 and 20 with respect to the drive force transmission engagement parts 43 and 43 of the rotor 40 can be retained in a stabilized state.

Thus, the strength of the slide pins 10 and 20 is secured by providing the recessed parts 102 and 202 with the reinforcement walls 102*b* and 202*b* for closing the recessed parts 102 and 202 at, of side portions in a direction perpendicular to longitudinal directions of the slide pins 10 and 20, one side portion positioned radial outward the rotor 40. In addition, by providing the openings 102*a* and 202*a* for opening the recessed parts 102 and 202 at the other side portion positioned radial inward the rotor 40 and opposed to the reinforcement walls 102*b* and 202*b*, when the drive force transmission parts 43 and 43 of the rotor 40 slidingly moves in the direction perpendicular to the longitudinal directions of the slide pins 10 and 20 within the recessed parts 102 and 202, portions of the drive force transmission parts 43 and 43 are allowed to protrude from the openings 102*a* and 202*a*. Accordingly, it is possible to reduce a width in the direction perpendicular to the longitudinal directions of the slide pins 10 and 20.

Therefore, while the slide pin 10 and 20 are reduced in the width to be thinner, the strength thereof is secured by the reinforcement walls 102*b* and 202*b*, and the movable range of the drive force transmission parts 43 and 43 is widely kept by the openings 102*a* and 202*a*. As a result, there is an advantage that the moving amount of the slide pins 10 and 20 can be kept long even if the diameter of the rotor 40 is small.

In the present embodiment, as shown in FIG. 16, the slide pin 10 is provided with a resilient piece 131 for suppressing backlash in the forward and backward directions of the same slide pin 10 and a pair of resilient pieces 141 and 141 for suppressing backlash in the up and down directions. The resilient piece 131 urges the projection piece 7 provided on the rear side of the lid 1 into the forward and backward directions of the slide pin 10 (Refer to FIG. 21). Also, the resilient pieces 141 and 141 urge the projection piece 7 in the up and down directions of the same slide pin 10.

Further, in the present embodiment, the slide pin 20 is provided with a resilient piece 231 for suppressing backlash in the forward and backward directions of the same slide pin 20 and a pair of resilient pieces 241 and 241 for suppressing backlash in the up and down directions. The resilient piece 231 urges the projection piece 7 provided on the rear side of the lid 1 in the forward and backward directions of the same slide pin 20 (Refer to FIG. 21), and the resilient pieces 241 and 241 urge the projection piece 7 in the up and down directions of the same slide pin 20.

In addition, it is a matter of course that the present invention is not limited to the above-described embodiments.

For example, the operation member may be composed of push-button type operation buttons instead of the operation handle 50.

The invention claimed is:

1. A side-lock device mounted in a lid for opening and closing a vehicle glove box, which holds the lid in a closed state, the side-lock device comprising:

a pair of left and right slide pins disposed on a rear side of the lid so as to be movable in a lateral direction, the tip ends of the slid pins being caused to respectively protrude from both side edges of the lid so as to be engaged with locking parts provided at a vehicle side to thereby hold the lid in the closed state, the slide pins including engaged parts, respectively;

a base member installed from a surface side of the lid, the base member having a spring lock part;

an operating member mounted on a surface side of the base member;

a rotor that is rotatably installed in the base member so as to be rotated by the operating member to thereby drive the slide pins in an interlocked manner, the rotor including a pair of drive force transmission engagement parts at one side thereof so as to be locked with the engaged parts of the slide pins, respectively, the rotor also including a spring force receiving part at an other side thereof; and a torsion coil spring disposed in the base member so as to urge the rotor in a first direction to an original position thereof, the torsion coil spring having a first end contacting the spring lock part of the base member and a second end contacting the spring force receiving part of the rotor, wherein, the side-lock device is mounted into the lid such that:

the rotor is mounted to the base member so that the drive force transmission engagement parts are exposed to the rear side of the lid, and the respective slide pins are attached from the rear side of the lid so that the engaged parts engage with the respective drive force transmission engagement parts, wherein at least one of the base member and the rotor includes a rotation direction restricting mechanism which restricts a rotation of the rotor in the first direction while allowing the rotation of the rotor in a second direction, and wherein the rotor is mounted to the base member such that:

the torsion coil spring is disposed in the base member so that the first end thereof is locked to the spring lock part, the rotor is mounted to the base member so that the spring force receiving part thereof contacts the second end of the torsion coil spring without causing an elastic deformation of the torsion coil spring, and the rotor is rotated in the second direction so that the elastic deformation of the coil spring is caused and the rotation direction restricting mechanism restricts the rotor from rotating in the first direction.

2. The side-lock device according to claim 1, wherein the base member has a recess extending from one side end face thereof to an other side end face thereof formed at a rear side thereof for accommodating the slide pins, and a plurality of retaining projections for retaining the respective slide pins so as to allow the slide pins to slide in the recess in the lateral direction.

3. The side-lock device according to claim 2, wherein, in a state where the slide pins are moved beyond a range driven by the operation member, an installation recessed part through which the retaining projection is passable in accordance with moving operations of the respective slide pins in the forward and backward directions is formed at the position corresponding to the retaining projection in the respective slide pins.

4. The side-lock device according to claim 1, wherein the operation member is an operation handle rotatably mounted in the base member and operated for turning by applying a finger to the rear side of the operation member from downward.

5. The side-lock device according to claim 4, wherein an installation part for installing the base member is formed in the lid, the installation part includes an opening area passing through the lid from the surface thereof to the rear side thereof, an operation space being formed at a downward area of the opening portion so as to allow a hand to insert into the rear side of the operation handle therethrough, and a partition partitioning the rearward of the operation space, and wherein the base member is tightened to the partition, and is configured so that the rotor is installed in the portion where the base member is disposed in the opening area, and the engaged part of the respective slide pins is engaged with the drive force transmission engagement part of the rotor from the rear side of the lid.

6. The side-lock device according to claim 4, wherein the base member has the installation part of the rotor formed further sideways in one direction from a middle position thereof in a width direction, wherein the slide pin extending sideways in the one direction is made into a drive. slide pin, and the slide pin extending sideways in the other direction comprise drive slide pins, wherein a drive force receiving part that receives an operation drive force from the operation handle and cause a tip end of the drive slide pin to move in a direction to be disengaged from the locking part at the vehicle side is formed at an other sideward portion not interfering with the installation part of the rotor in the drive slide pin.

7. The side-lock device according to claim 6, wherein the operation handle includes a drive projection protruding to the rear side, and wherein the drive force receiving part of the drive slide pin is configured so that the drive force receiving part receives an operation drive force from the drive projection in accordance with turning operations of the operation handle, and converts the operation drive force to a force for causing the tip end of the drive slide pin to move in the direction to be disengaged from the locking part at the vehicle side.

8. The side-lock device according to claim 7, wherein the drive force receiving part has an inclination surface with which the drive projection is brought into sliding contact and which movement of the drive projection in accordance with turning operations of the operation handle is converted to movement of the drive slide pin in the lateral direction thereof.

9. The side-lock device according to claim 8, wherein the drive force receiving part has a bottom surface that is brought into sliding contact with the base member, the inclination surface is formed upward of the bottom surface, and the drive projection moves from the position opposed to the bottom surface and is brought into sliding contact with the inclination surface.

10. The side-lock device according to claim 8, wherein the drive projection is selectively movable to a drive position where the drive projection is brought into sliding contact with the inclination surface in accordance with drive operation of the operation handle and a non-drive position where the drive projection is not brought into sliding contact with the inclination surface even if the operation handle is operated and driven.

11. The side-lock device according to claim 10, wherein a key cylinder that is allowed to turn and operate by inserting a specified key thereinto is installed in the operation handle, and wherein the drive projection is configured so that the drive projection protrudes from the rear face of the key cylinder and selectively moves between the drive position and the non-drive position in accordance with turning operations of the key cylinder.

12. The side-lock device according to claim 11, wherein the drive projection is configured so that the drive projection regulates movement of the drive slide pin in the direction along which the tip end of the drive slide pin is disengaged from the locking position at the vehicle side when the drive projection is in the non-drive position.

13. The side-lock device according to claim 12, wherein the drive force receiving part includes:

a movement regulating end face that is brought into contact with the drive projection located at the non-drive position and the tip end of the drive slide pin regulates movements of the drive slide pin in the direction to be disengaged from the locking part at the vehicle side; and a notched part that is formed between the inclination surface and the movement regulating end face and secures a moving track for the drive projection.

14. The side-lock device according to claim 4, wherein the operation handle includes a drive projection protruding to the rear side, wherein a drive force receiving part that is brought into contact with the drive projection and receives an operation drive force from the operation handle is formed at the rotor, wherein the drive force receiving part of the rotor includes an extension area with which the drive projection is brought into contact in a state where the operation handle is not operated, and an arcuate face area with which the drive projection is brought into contact in the course of turning the operation handle, wherein the arcuate face area is formed nearer to a center of rotation of the rotor than the extension area, and wherein the extension area is formed continuously to the arcuate face area so as to extend in a tangential direction of the arcuate face area and in a direction of parting from a center of rotation. of the rotor.

15. The side-lock device according to claim 1, wherein the rotor is formed into a cylinder one end face of which is opened and the other end face of which is closed, and a cylinder facing close to the circumferential surface of the rotor is provided on the base member, and grease is supplied in clearances between these cylinders to provide viscosity resistance with respect to rotations of the rotor.

16. The side-lock device according to claim 1, wherein a retaining structure to retain the slide pin at the rotor is provided between the drive force transmission engagement part of the rotor and the engaged part of the slide pin.

17. The side-lock device according to claim 16, wherein the drive force transmission engagement part of the rotor comprises a columnar projection having a head portion a diameter of which is greater than a diameter of a body part of the columnar projection, wherein the engaged part of the slide pin is formed to be a recessed part fitted with the head portion of the columnar projection, and wherein a locking claw resiliently engaged with the head portion of the columnar projection is formed at a part of the sidewall forming the recessed part, and the retaining structure is configured so that the locking claw is meshed and engaged with the head portion of the columnar projection.

18. The side-lock device according to claim 1, wherein the drive force transmission engagement part of the rotor comprises a columnar projection, wherein the engaged part of the slide pin comprises a recessed part fitted with the columnar projection, and wherein the recessed part is configured so that, when the rotor turns in a range permitted to turn, the portion where the columnar projection is exposed beyond an inner side face of the recessed part is made open, and at a same time, a reinforcement wall is formed at a side portion with which the column projection is not brought into contact.

19. The side-lock device according to claim 1, wherein the rotation direction restricting mechanism includes:

a stopper wall formed on the base member; and a contacting claw which is inclined so as to deflect to ride over the stopper wall when the rotor rotates in the second direction and so as not to deflect to solidly contact the stopper wall when the rotor rotates in the first direction.

20. The side-lock device according to claim 19, wherein the rotor is mounted to the base member such that:

the torsion coil spring is disposed in the base member so that the first end thereof is locked between the spring lock part and the stopper wall, the rotor is mounted to the base member so that the spring force receiving part thereof contacts the second end of the torsion coil spring without causing the elastic deformation of the torsion coil spring, and the rotor is rotated in the second direction while causing the elastic deformation of the torsion coil spring until the contacting claw rides over the stopper wall so that the rotor is restricted from excessively rotating in the first direction and the torsion coil spring is held in an elastically-deformed state.

* * * * *